US006464341B1

(12) United States Patent
Furlani et al.

(10) Patent No.: US 6,464,341 B1
(45) Date of Patent: Oct. 15, 2002

(54) DUAL ACTION THERMAL ACTUATOR AND METHOD OF OPERATING THEREOF

(75) Inventors: Edward P. Furlani, Lancaster; John A. Lebens, Rush; David P. Trauernicht, Rochester, all of NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/068,859

(22) Filed: Feb. 8, 2002

(51) Int. Cl.[7] ..... B41J 2/04; B41J 2/05; B41J 2/015

(52) U.S. Cl. ..... 347/54; 347/56; 347/20

(58) Field of Search ..... 347/20, 44, 47, 347/54, 55, 56; 551/70, 11; 310/306, 307; 337/140, 141, 139

(56) References Cited

U.S. PATENT DOCUMENTS

| | | | | | |
|---|---|---|---|---|---|
| 3,747,120 | A | * | 7/1973 | Stemme | 347/70 |
| 3,946,398 | A | * | 3/1976 | Kyser et al. | 347/70 |
| 4,296,241 | A | | 10/1981 | Hara et al. | 347/48 |
| 5,599,695 | A | | 2/1997 | Pease et al. | 435/91.1 |
| 5,771,882 | A | | 6/1998 | Psaros et al. | 128/203 |
| 5,902,648 | A | | 5/1999 | Naka et al. | 427/558 |
| 6,067,797 | A | | 5/2000 | Silverbrook et al. | 60/528 |
| 6,209,989 | B1 | | 4/2001 | Silverbrook | 347/54 |
| 6,234,609 | B1 | | 5/2001 | Silverbrook | 347/54 |
| 6,239,821 | B1 | | 5/2001 | Silverbrook | 347/54 |
| 6,243,113 | B1 | | 6/2001 | Silverbrook | 347/54 |
| 6,247,791 | B1 | | 6/2001 | Silverbrook | 347/54 |
| 6,254,793 | B1 | | 7/2001 | Silverbrook | 216/27 |
| 6,258,284 | B1 | | 7/2001 | Silverbrook | 216/27 |
| 6,274,056 | B1 | | 9/2001 | Silverbrook | 216/27 |

FOREIGN PATENT DOCUMENTS

| | | |
|---|---|---|
| JP | 20330543 | 1/1990 |

* cited by examiner

*Primary Examiner*—John Barlow
*Assistant Examiner*—Juanita Stephens
(74) *Attorney, Agent, or Firm*—William R. Zimmerli

(57) ABSTRACT

An apparatus for and method of operating a thermal actuator for a micromechanical device, especially a liquid drop emitter such as an ink jet printhead, is disclosed. The disclosed thermal actuator comprises a base element and a cantilevered element extending from the base element and normally residing at a first position before activation. The cantilevered element includes a barrier layer constructed of a low thermal conductivity material, bonded between a first deflector layer and a second deflector layer, both of which are constructed of electrically resistive materials having substantially equal coefficients of thermal expansion. The thermal actuator further comprises a first pair of electrodes connected to the first deflector layer and a second pair of electrodes is connected to the second deflector layer for applying electrical pulses to cause resistive heating of the first or second deflector layers, resulting in thermal expansion of the first or second deflector layer relative to the other. Application of an electrical pulse to either pair of electrodes causes deflection of the cantilevered element away from its first position and, alternately, causes a positive or negative pressure in the liquid at the nozzle of a liquid drop emitter. Application of electrical pulses to the pairs of is used to adjust the characteristics of liquid drop emission. The barrier layer exhibits a heat transfer time constant $\tau_B$. The thermal actuator is activated by a heat pulses of duration $\tau_P$ wherein $\tau_P < \frac{1}{2}\tau_B$.

35 Claims, 18 Drawing Sheets

DUAL ACTION THERMAL ACTUATOR AND METHOD OF OPERATING THEREOF

CROSS REFERENCE TO RELATED APPLICATION

Reference is made to commonly-assigned co-pending U.S. patent application Ser. No. 10/071,120 entitled "Tri-layer Thermal Actuator and Method of Operating", of Furlani et al.

FIELD OF THE INVENTION

The present invention relates generally to micro-electromechanical devices and, more particularly, to micro-electromechanical thermal actuators such as the type used in ink jet devices and other liquid drop emitters.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electrically resistive heaters to generate vapor bubbles which cause drop emission, as is discussed by Hara et al., in U.S. Pat. No. 4,296,421.

Electrically resistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combine the advantages of microelectronic fabrication used for thermal ink jet with the liquid composition latitude available to piezo-electro-mechanical devices.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently, disclosures of a similar thermo-mechanical DOD ink jet configuration have been made by K. Silverbrook in U.S. Pat. Nos. 6,067,797; 6,209,989; 6,234,609; 6,239,821; 6,243,113 and 6,247,791. Methods of manufacturing thermo-mechanical ink jet devices using microelectronic processes have been disclosed by K. Silverbrook in U.S. Pat. Nos. 6,254,793; 6,258,284 and 6,274,056. The term "thermal actuator" and thermo-mechanical actuator will be used interchangeably herein.

Thermo-mechanically actuated drop emitters are promising as low cost devices which can be mass produced using microelectronic materials and equipment and which allow operation with liquids that would be unreliable in a thermal ink jet device. Thermal actuators and thermal actuator style liquid drop emitters are needed which allow the movement of the actuator to be controlled to produce a predetermined displacement as a function of time. Highest repetition rates of actuation, and drop emission consistency, may be realized if the thermal actuation can be electronically controlled in concert with stored mechanical energy effects.

For liquid drop emitters, the drop generation event relies on creating a pressure impulse in the liquid at the nozzle, but also on the state of the liquid meniscus at the time of the pressure impulse. The characteristics of drop generation, especially drop volume, velocity and satellite formation may be affected by the specific time variation of the displacement of the thermal actuator. Improved print quality may be achieved by varying the drop volume to produce varying print density levels, by more precisely controlling target drop volumes, and by suppressing satellite formation. Printing productivity may be increased by reducing the time required for the thermal actuator to return to a nominal starting displacement condition so that a next drop emission event may be initiated.

Apparatus and methods of operation for thermal actuators and DOD emitters are needed which enable improved control of the time varying displacement of the thermal actuator so as to maximize the productivity of such devices and to create liquid pressure profiles for favorable liquid drop emission characteristics.

A useful design for thermo-mechanical actuators is a cantilevered beam anchored at one end to the device structure with a free end that deflects perpendicular to the beam. The deflection is caused by setting up thermal expansion gradients in the beam in the perpendicular direction. Such expansion gradients may be caused by temperature gradients or by actual materials changes, layers, thru the beam. It is advantageous for pulsed thermal actuators to be able to establish the thermal expansion gradient quickly, and to dissipate it quickly as well. It is further beneficial to actively generate opposing thermal expansion gradients to assist in restoring the actuator to its initial position. This may be achieved by having dual actuation means operating to deflect a cantilevered beam in substantially opposite directions.

A dual actuation thermal actuator configured to generate opposing thermal expansion gradients, hence opposing beam deflections, is useful in a liquid drop emitter to generate pressure impulses at the nozzle which are both positive and negative. Control over the generation and timing of both positive and negative pressure impulses allows fluid and nozzle meniscus effects to be used to favorably alter drop emission characteristics.

Cantilevered element thermal actuators, which can be deflected in controlled displacement versus time profiles, are needed in order to build systems that can be fabricated using MEMS fabrication methods and also enable liquid drop emission at high repetition frequency with excellent drop formation characteristics.

SUMMARY OF THE INVENTION

It is therefore an object of the present invention to provide a thermal actuator which comprises dual actuation means that move the thermal actuator in substantially opposite directions allowing rapid restoration of the actuator to a nominal position and more rapid repetitions.

It is also an object of the present invention to provide a liquid drop emitter which is actuated by a dual activation thermal actuator configured using a cantilevered element.

It is further an object of the present invention to provide a method of operating a thermal actuator utilizing dual actuations to achieve a predetermined resultant time varying displacement.

It is further an object of the present invention to provide a method of operating a liquid drop emitter having a thermal actuator utilizing dual actuations to adjust a characteristic of the liquid drop emission.

The foregoing and numerous other features, objects and advantages of the present invention will become readily apparent upon a review of the detailed description, claims and drawings set forth herein. These features, objects and advantages are accomplished by constructing a thermal actuator for a micro-electromechanical device comprising a base element and a cantilevered element extending from the base element and normally residing at a first position before activation. The cantilevered element includes a barrier layer constructed of a low thermal conductivity material, bonded between a first deflector layer constructed of a first electrically resistive material having a large coefficient of thermal expansion and a second deflector layer constructed of a second electrically resistive material having a large coefficient of thermal expansion. The thermal actuator further comprises a first pair of electrodes connected to the first deflector layer to apply an electrical pulse to cause resistive heating of the first deflector layer, resulting in a thermal expansion of the first deflector layer relative to the second deflector layer. A second pair of electrodes is connected to the second deflector layer to apply an electrical pulse to cause resistive heating of the second deflector layer, resulting in a thermal expansion of the second deflector layer relative to the first deflector layer. Application of an electrical pulse to either the first pair or the second pair of electrodes causes deflection of the cantilevered element away from the first position to a second position, followed by restoration of the cantilevered element to the first position as heat diffuses through the barrier layer and the cantilevered element reaches a uniform temperature.

The present invention is particularly useful as a thermal actuator for liquid drop emitters used as printheads for DOD ink jet printing. In this preferred embodiment the thermal actuator resides in a liquid-filled chamber that includes a nozzle for ejecting liquid. The thermal actuator includes a cantilevered element extending from a wall of the chamber and a free end residing in a first position proximate to the nozzle. Application of an electrical pulse to either the first pair or the second pair of electrodes causes deflection of the cantilevered element away from its first position and, alternately, causes a positive or negative pressure in the liquid at the nozzle. Application of electrical pulses to the first and second pairs of electrodes, and the timing thereof, are used to adjust the characteristics of liquid drop emission.

DETAILED DESCRIPTION OF THE INVENTION

The invention has been described in detail with particular reference to certain preferred embodiments thereof but it will be understood that variations and modifications can be effected within the spirit and scope of the invention.

As described in detail herein below, the present invention provides apparatus for a thermo-mechanical actuator and a drop-on-demand liquid emission device and methods of operating same. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide apparatus and methods for operating drop emitters based on thermal actuators so as to improve overall drop emission productivity.

Figure 1:
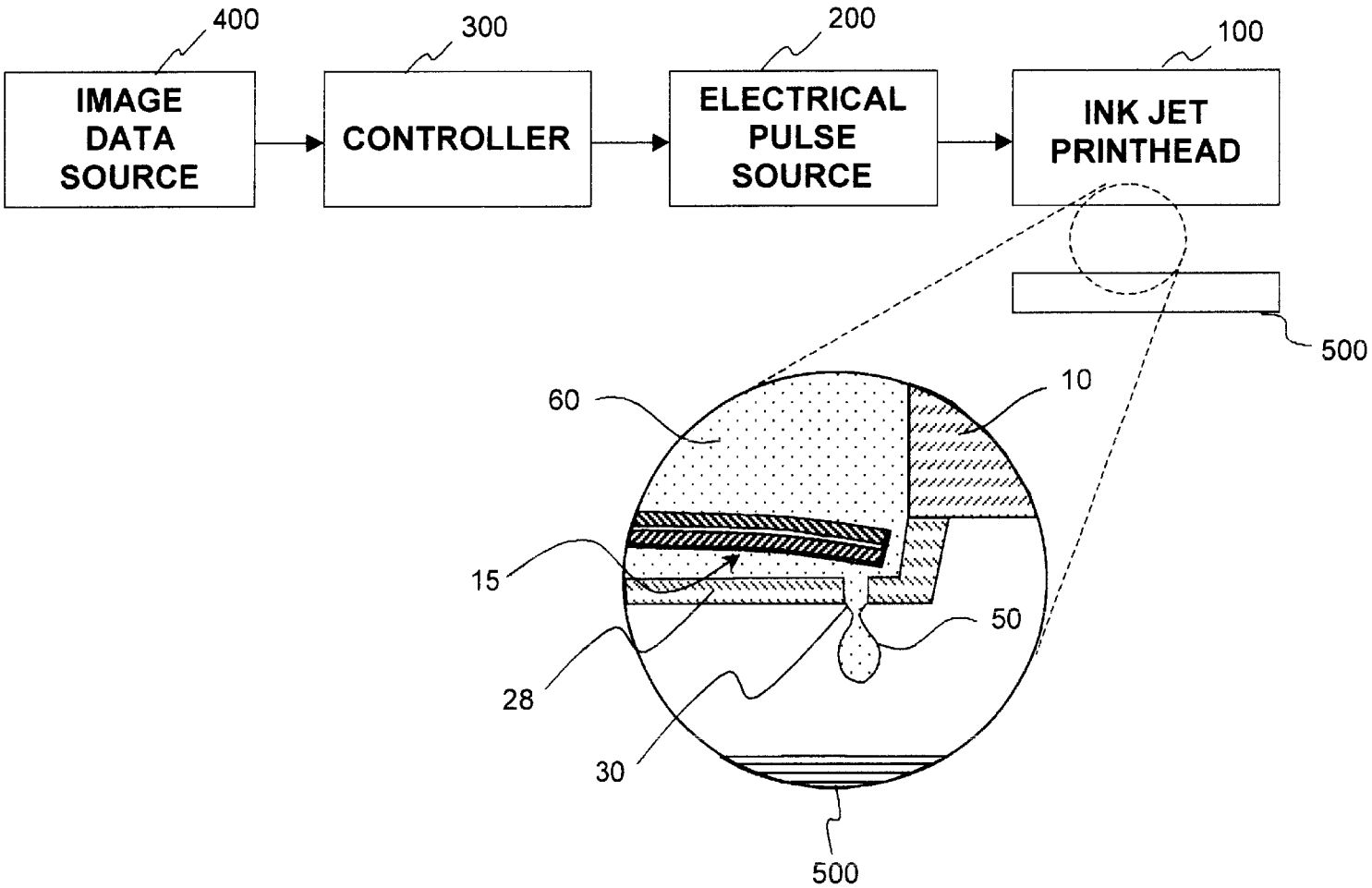
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermal actuator 15 within ink jet printhead 100. The electrical energy pulses cause a thermal actuator 15 to rapidly bend, pressurizing ink 60 located at nozzle 30, and emitting an ink drop 50 which lands on receiver 500. The present invention causes the emission of drops having substantially the same volume and velocity, that is, having volume and velocity within +/−20% of a nominal value. Some drop emitters may emit a main drop and very small trailing drops, termed satellite drops. The present invention assumes that such satellite drops are considered part of the main drop emitted in serving the overall application purpose, e.g., for printing an image pixel or for micro dispensing an increment of fluid.

Figure 2:
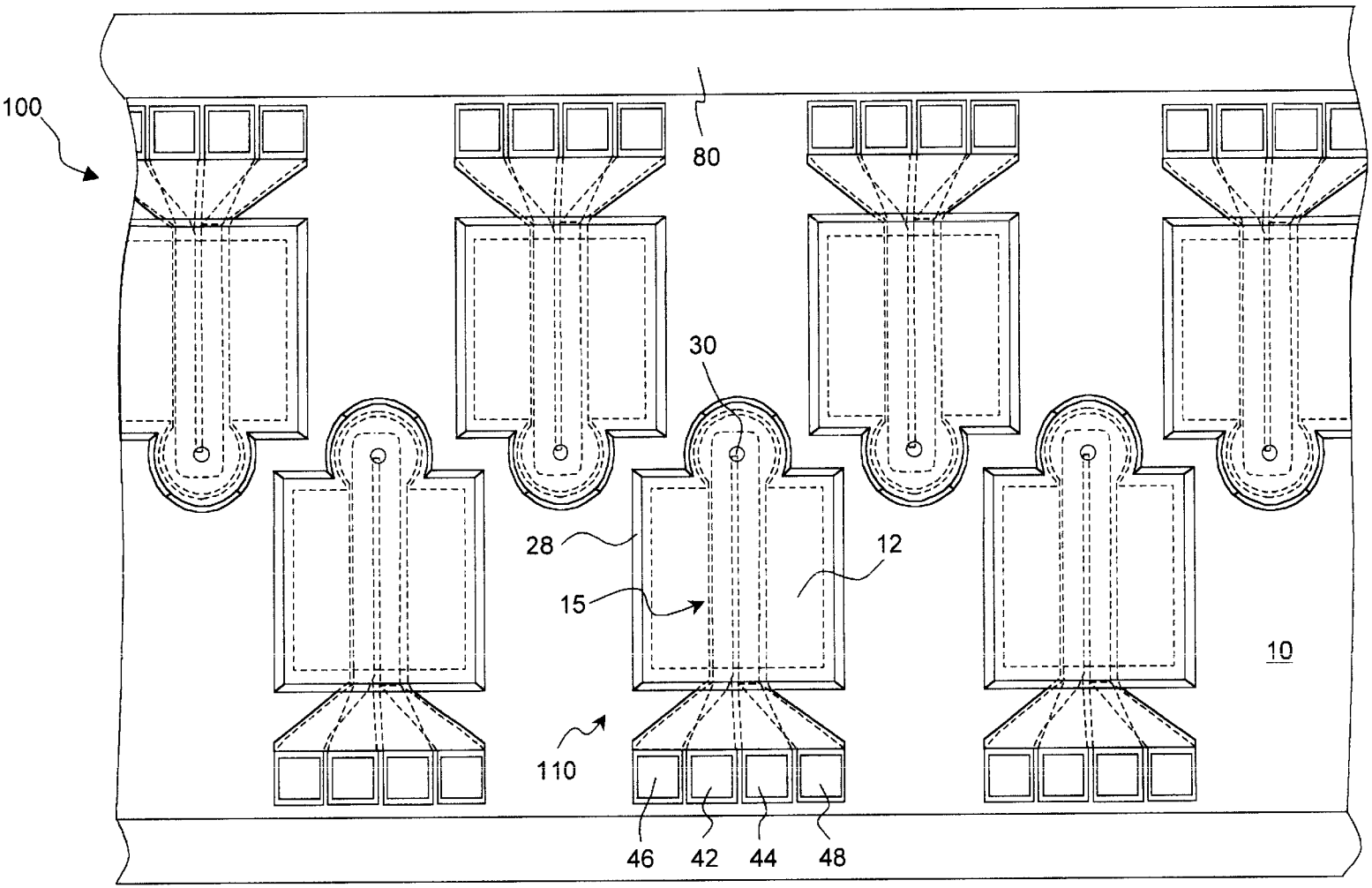
FIG. 2 is a plan view of an array of ink jet units or liquid drop emitter units according to the present invention.

FIG. 2 shows a plan view of a portion of ink jet printhead 100. An array of thermally actuated ink jet units 110 is shown having nozzles 30 centrally aligned, and ink chambers 12, interdigitated in two rows. The ink jet units 110 are formed on and in a substrate 10 using microelectronic fabrication methods. An example fabrication sequence which may be used to form drop emitters 110 is described in co-pending application Ser. No. 09/726,945 filed Nov. 30, 2000, for "Thermal Actuator", assigned to the assignee of the present invention.

Each drop emitter unit 110 has associated electrodes 42, 44 which are formed with, or are electrically connected to, a u-shaped electrically resistive heater portion in a first deflector layer of the thermal actuator 15 and which participates in the thermo-mechanical effects as will be described hereinbelow. Each drop emitter unit 110 also has associated electrodes 46, 48 which are formed with, or are electrically connected to, a u-shaped electrically resistive heater portion in a second deflector layer of the thermal actuator 15 and which also participates in the thermo-mechanical effects as will be described hereinbelow. The u-shaped resistor portions formed in the first and second deflector layers are exactly above one another and are indicated by phantom lines in FIG. 2. Element 80 of the printhead 100 is a mounting structure which provides a mounting surface for microelectronic substrate 10 and other means for interconnecting the liquid supply, electrical signals, and mechanical interface features.

Figure 3A:
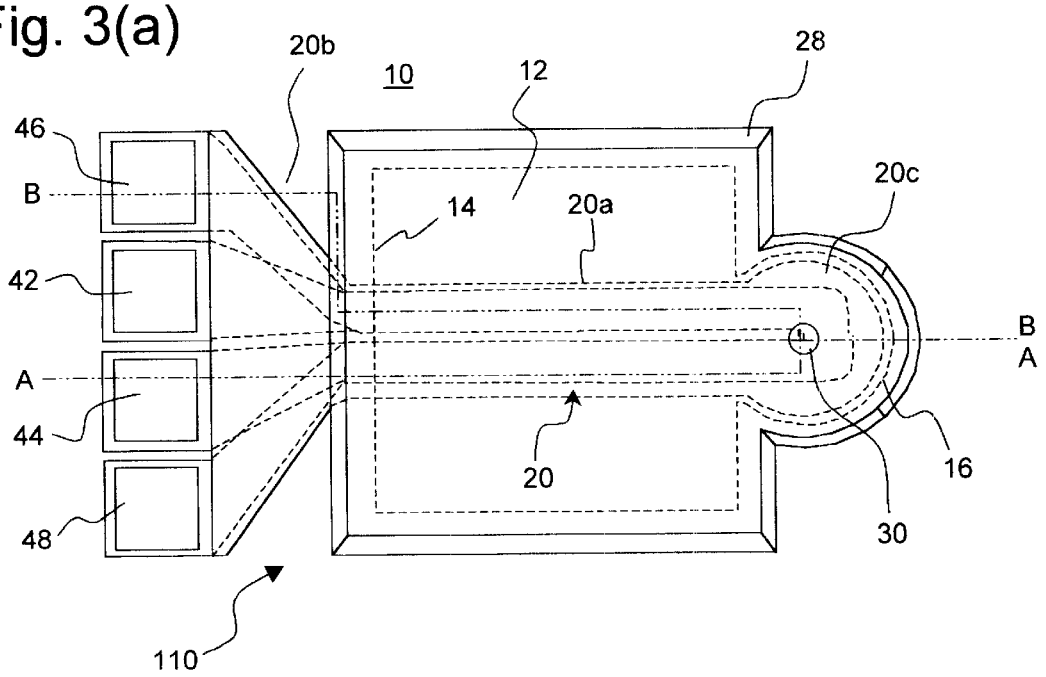
FIGS. 3(*a*) and 3(*b*) is an enlarged plan view of an individual ink jet unit shown in FIG. 2.
Figure 3B:
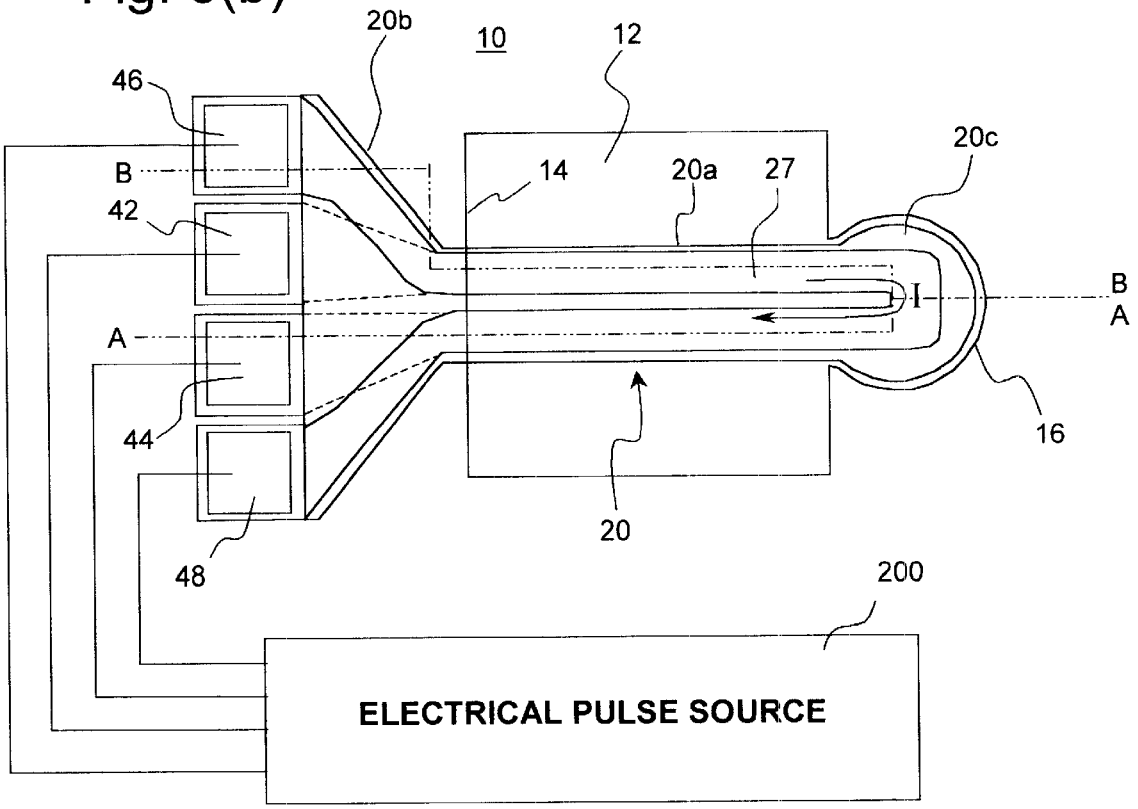

FIG. 3*a* illustrates a plan view of a single drop emitter unit 110 and a second plan view FIG. 3*b* with the liquid chamber cover 28, including nozzle 30, removed.

The thermal actuator 15, shown in phantom in FIG. 3*a* can be seen with solid lines in FIG. 3*b*. The cantilevered element 20 of thermal actuator 15 extends from edge 14 of liquid chamber 12 which is formed in substrate 10. Cantilevered element portion 20*b* is bonded to substrate 10 and anchors the cantilever.

The cantilevered-element 20 of the actuator has the shape of a paddle, an extended flat shaft ending with a disc of larger diameter than the shaft width. This shape is merely illustrative of cantilever actuators which can be used, many other shapes are applicable. The paddle shape aligns the nozzle 30 with the center of the actuator free end 20*c*. The fluid chamber 12 has a curved wall portion at 16 which conforms to the curvature of the actuator free end 20*c*, spaced away to provide clearance for the actuator movement.

FIG. 3*b* illustrates schematically the attachment of electrical pulse source 200 to electrically resistive heater portion 27 of the second deflector layer at a second pair of electrodes 46 and 48. Voltage differences are applied to voltage terminals 46 and 48 to cause resistance heating of the second deflector layer via u-shaped resistor 27. This is generally indicated by an arrow showing a current I. The u-shaped resistor portion 26 of the first deflector layer is hidden below resistive heater portion 27 (and a barrier layer) but can be seen indicated by phantom lines emerging to make contact to a first pair of electrodes 42 and 44. Voltage differences are applied to voltage terminals 42 and 44 to cause resistance heating of the first deflector layer via u-shaped resistor 26. While illustrated as four separate electrodes 42,44,46, and 48, having connections to electrical pulse source 200, one member of each pair of electrodes could be brought into electrical contact at a common point so that resistive heater portions 26 and 27 could be addressed using three inputs from electrical pulse source 200.

In the plan views of FIG. 3, the actuator free end 20*c* moves toward the viewer when the first deflector layer is heated appropriately by resistor portion 26 and drops are emitted toward the viewer from the nozzle 30 in cover 28. This geometry of actuation and drop emission is called a "roof shooter" in many ink jet disclosures. The actuator free end 20*c* moves away from the viewer of FIG. 3, and nozzle 30, when the second deflector layer is heated by resistor portion 27. This actuation of free end 20c away from nozzle 30 may be used to restore the cantilevered element 20 to a nominal position, to alter the state of the liquid meniscus at nozzle 30, to change the liquid pressure in the fluid chamber 12 or some combination of these and other effects.

Figure 4A:
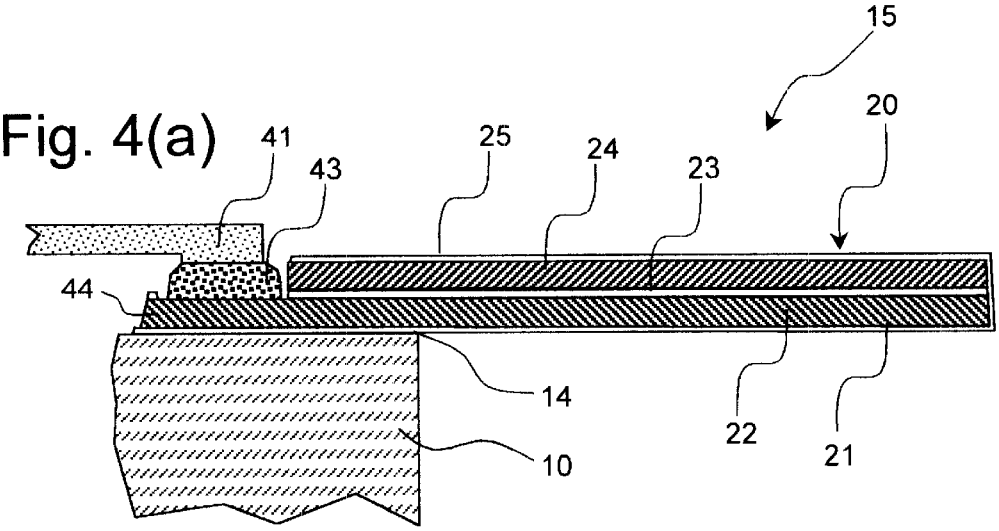
FIGS. 4(*a*), 4(*b*) and 4(*c*) is a side view illustrating the movement of a thermal actuator according to the present invention.
Figure 4B:
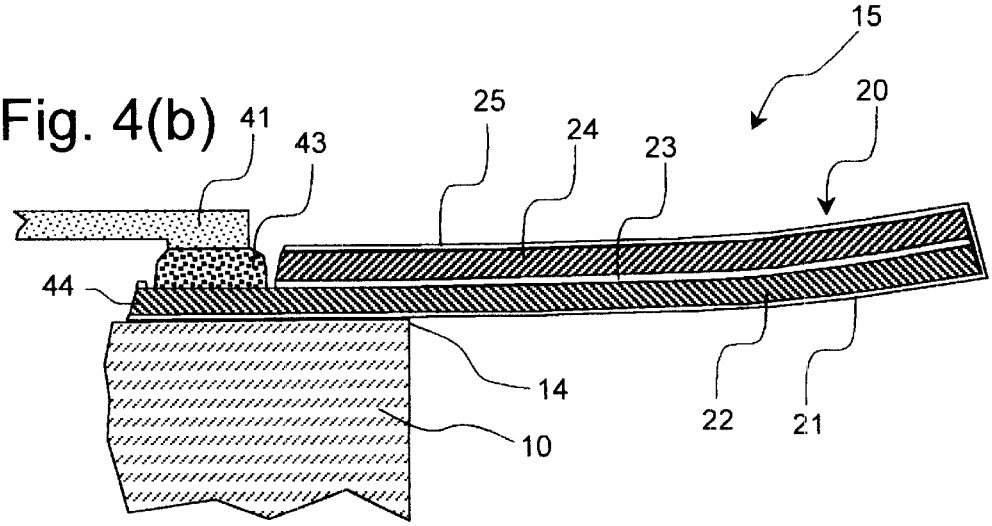
Figure 4C:
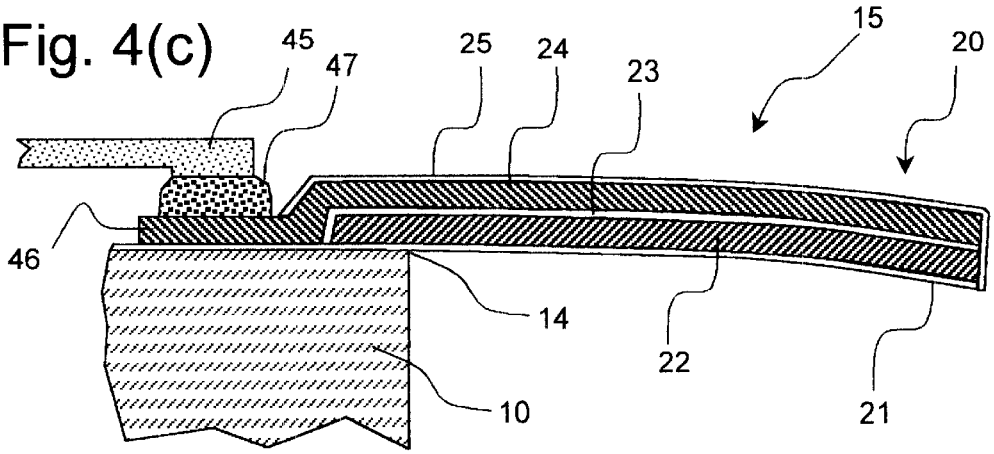

FIG. 4 illustrates in side view a cantilevered thermal actuator 15 according to a preferred embodiment of the present invention. In FIG. 4a thermal actuator 15 is in a first position and in FIG. 4b it is shown deflected upward to a second position. The side views of FIGS. 4a and 4b are formed along line A—A in plan view FIG. 3b. In side view FIG. 4c, formed along line B—B of plan view FIG. 3b, thermal actuator 15 is illustrated as deflected downward to a different second position. Cantilevered element 20 is anchored to substrate 10 which serves as a base element for the thermal actuator. Cantilevered element 20 extends from wall edge 14 of substrate base element 10.

Cantilevered element 20 is constructed of several layers. Layer 22 is the first deflector layer which causes the upward deflection when it is thermally elongated with respect to other layers in cantilevered element 20. Layer 24 is the second deflector layer which causes the downward deflection of thermal actuator 15 when it is thermally elongated with respect of the other layers in cantilevered element 20. First and second deflector layers are preferably constructed of materials that respond to temperature with substantially the same thermo-mechanical effects.

The second deflector layer mechanically balances the first deflector layer, and vice versa, when both are in thermal equilibrium This balance many be readily achieved by using the same material for both the first deflector layer 22 and the second deflector layer 24. The balance may also be achieved by selecting materials having substantially equal coefficients of thermal expansion and other properties to be discussed hereinbelow.

The cantilevered element 20 also includes a barrier layer 23, interposed between the first deflector layer 22 and second deflector layer 24. The barrier layer 23 is constructed of a material having a low thermal conductivity with respect to the thermal conductivity of the material used to construct the first deflector layer 24. The thickness and thermal conductivity of barrier layer 23 is chosen to provide a desired time constant $\tau_B$ for heat transfer from first deflector layer 24 to second deflector layer 22. Barrier layer 23 may also be a dielectric insulator to provide electrical insulation, and partial physical definition, for the electrically resistive heater portions of the first and second deflector layers.

Barrier layer 23 may be composed of sub-layers, laminations of more than one material, so as to allow optimization of functions of heat flow management, electrical isolation, and strong bonding of the layers of the cantilevered element 20. Multiple sub-layer construction of barrier layer 23 may also assist the discrimination of patterning fabrication processes utilized to form the resistor portions of the first and second deflector layers.

Passivation layers 21 and 25 shown in FIG. 4 are provided to protect the cantilevered element 20 chemically and electrically. Such protection may not be needed for some applications of thermal actuators according to the present invention, in which case they may be deleted. Liquid drop emitters utilizing thermal actuators which are touched on one or more surfaces by the working liquid may require passivation layers 21 and 25 which are chemically and electrically inert to the working liquid.

In FIG. 4b, a heat pulse has been applied to first deflector layer 22, causing it to rise in temperature and elongate. Second deflector layer 24 does not elongate initially because barrier layer 23 prevents immediate heat transfer to it. The difference in temperature, hence, elongation, between first deflector layer 22 and the second deflector layer 24 causes the cantilevered element 20 to bend upward. When used as actuators in drop emitters the bending response of the cantilevered element 20 must be rapid enough to sufficiently pressurize the liquid at the nozzle. Typically, electrical resistor portion 26 of the first deflector layer is adapted to apply appropriate heat pulses when an electrical pulse duration of less than 10 μsecs., and, preferably, a duration less than 4 μsecs., is used.

In FIG. 4c, a heat pulse has been applied to second deflector layer 24, causing it to rise in temperature and elongate. First deflector layer 22 does not elongate initially because barrier layer 23 prevents immediate heat transfer to it. The difference in temperature, hence, elongation, between second deflector layer 24 and the first deflector layer 22 causes the cantilevered element 20 to bend downward. Typically, electrical resistor portion 27 of the second deflector layer is adapted to apply appropriate heat pulses when an electrical pulse duration of less than 10 μsecs., and, preferably, a duration less than 4 μsecs., is used.

Depending on the application of the thermal actuator, the energy of the electrical pulses, and the corresponding amount of cantilever bending that results, may be chosen to be greater for one direction of deflection relative to the other. In many applications, deflection in one direction will be the primary physical actuation event. Deflections in the opposite direction will then be used to make smaller adjustments to the cantilever displacement for pre-setting a condition or for restoring the cantilevered element to its quiescent first position.

FIGS. 5 through 10 illustrate fabrication processing steps for constructing a single liquid drop emitter according to some of the preferred embodiments of the present invention. For these embodiments the first deflector layer 22 is constructed using an electrically resistive material, such as titanium aluminide, and a portion 26 is patterned into a resistor for carrying electrical current, I. A second deflector layer 24 is constructed also using an electrically resistive material, such as titanium aluminide, and a portion 27 is patterned into a resistor for carrying electrical current, I.

Figure 5:
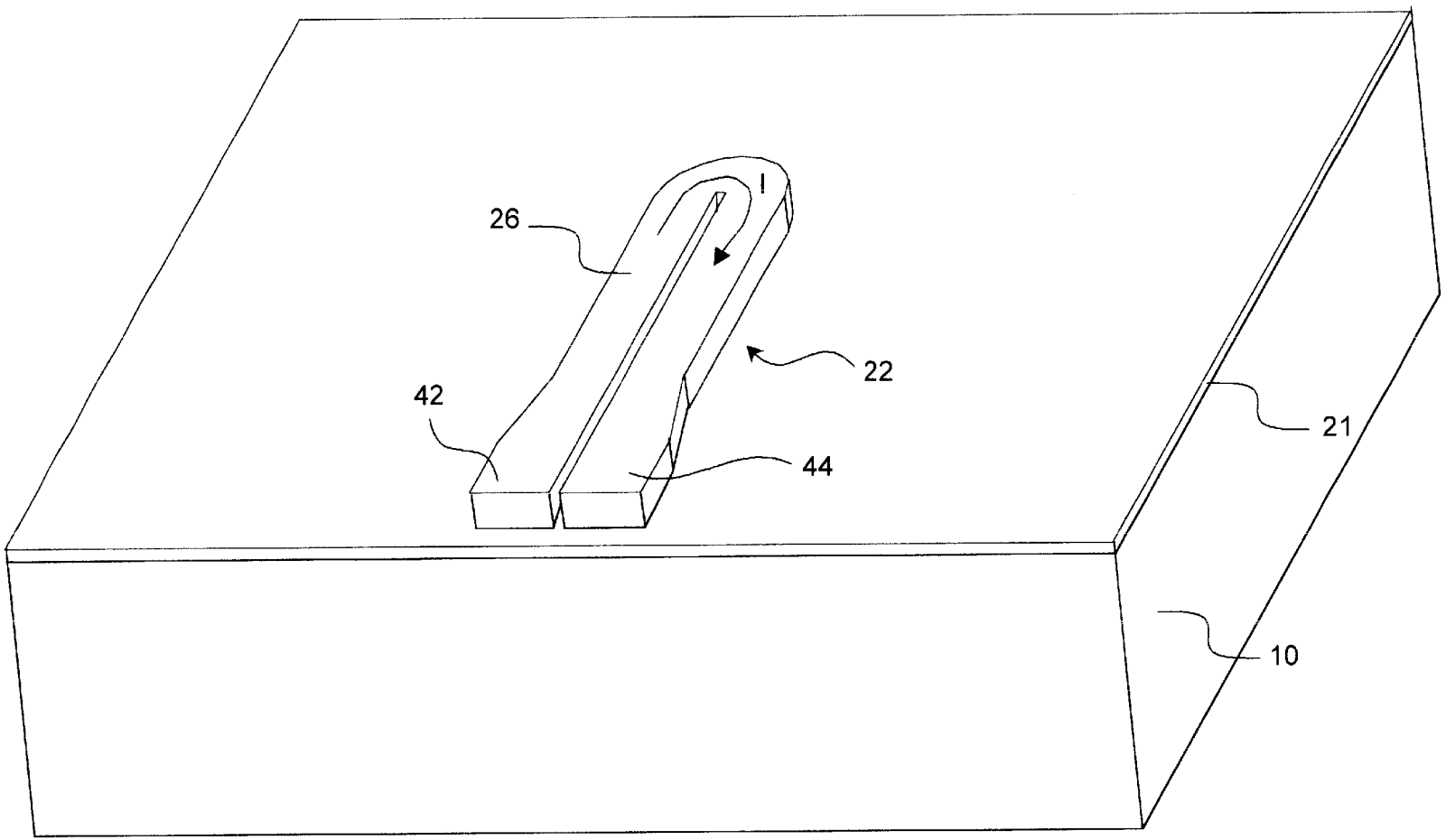
FIG. 5 is a perspective view of the early stages of a process suitable for constructing a thermal actuator according to the present invention wherein a first deflector layer of the cantilevered element is formed.

FIG. 5 illustrates a first deflector layer 22 portion of a cantilever in a first stage of fabrication. The illustrated structure is formed on a substrate 10, for example, single crystal silicon, by standard microelectronic deposition and patterning methods. Deposition of intermetallic titanium aluminide may be carried out, for example, by RF or pulsed DC magnetron sputtering. A resistor portion 26 is patterned in first deflector layer 22. The current path is indicated by an arrow and letter "I". A first pair of electrodes 42 and 44 for addressing the resistor portion 26 are illustrated as being formed in the first deflector layer 22 material. Electrodes 42, 44 may make contact with circuitry previously formed in substrate 10 or may be contacted externally by other standard electrical interconnection methods, such as tape automated bonding (TAB) or wire bonding. A passivation layer 21 is formed on substrate 10 before the deposition and patterning of the deflection layer material. This passivation layer may be left under deflection layer 22 and other subsequent structures or patterned away in a subsequent patterning process.

Figure 6:
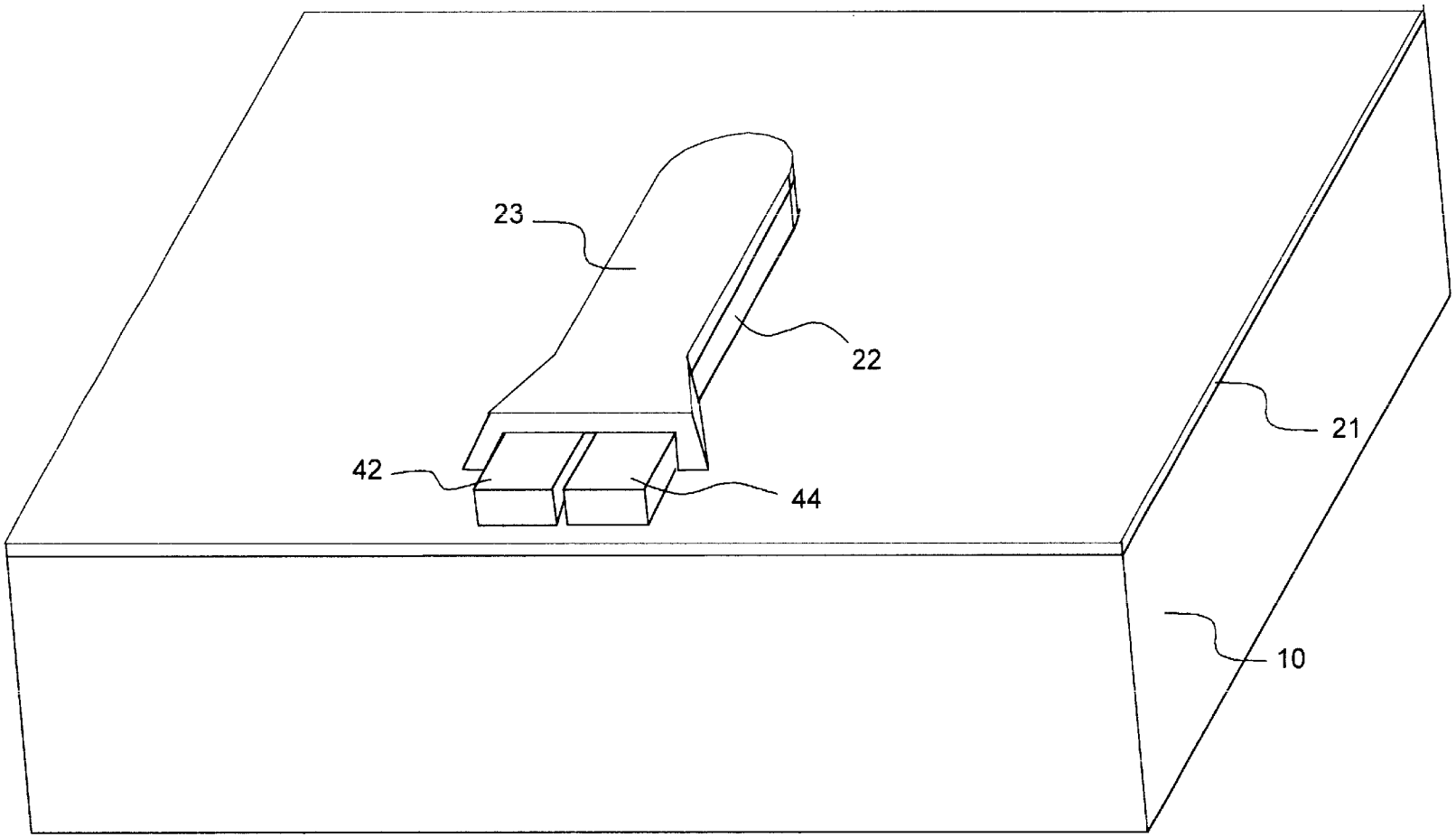
FIG. 6 is a perspective view of the next stages of the process illustrated in FIG. 5 wherein a barrier layer of the cantilevered element is formed.

FIG. 6 illustrates a barrier layer 23 having been deposited and patterned over the previously formed first deflector layer 22 portion of the thermal actuator. The barrier layer 23 material has low thermal conductivity compared to the first deflector layer 22. For example, barrier layer 23 may be silicon dioxide, silicon nitride, aluminum oxide or some multi-layered lamination of these materials or the like.

Favorable efficiency of the thermal actuator is realized if the barrier layer 23 material has thermal conductivity substantially below that of both the first deflector layer 22 material and the second deflector layer 24 material. For example, dielectric oxides, such as silicon oxide, will have thermal conductivity several orders of magnitude smaller than intermetallic materials such as titanium aluminide. Low thermal conductivity allows the barrier layer 23 to be made thin relative to the first deflector layer 22 and second deflector layer 24. Heat stored by barrier layer 23 is not useful for the thermo-mechanical actuation process. Minimizing the volume of the barrier layer improves the energy efficiency of the thermal actuator and assists in achieving rapid restoration from a deflected position to a starting first position. The thermal conductivity of the barrier layer 23 material is preferably less than one-half the thermal conductivity of the first deflector layer or second deflector layer materials, and more preferably, less than one-tenth.

Figure 7:
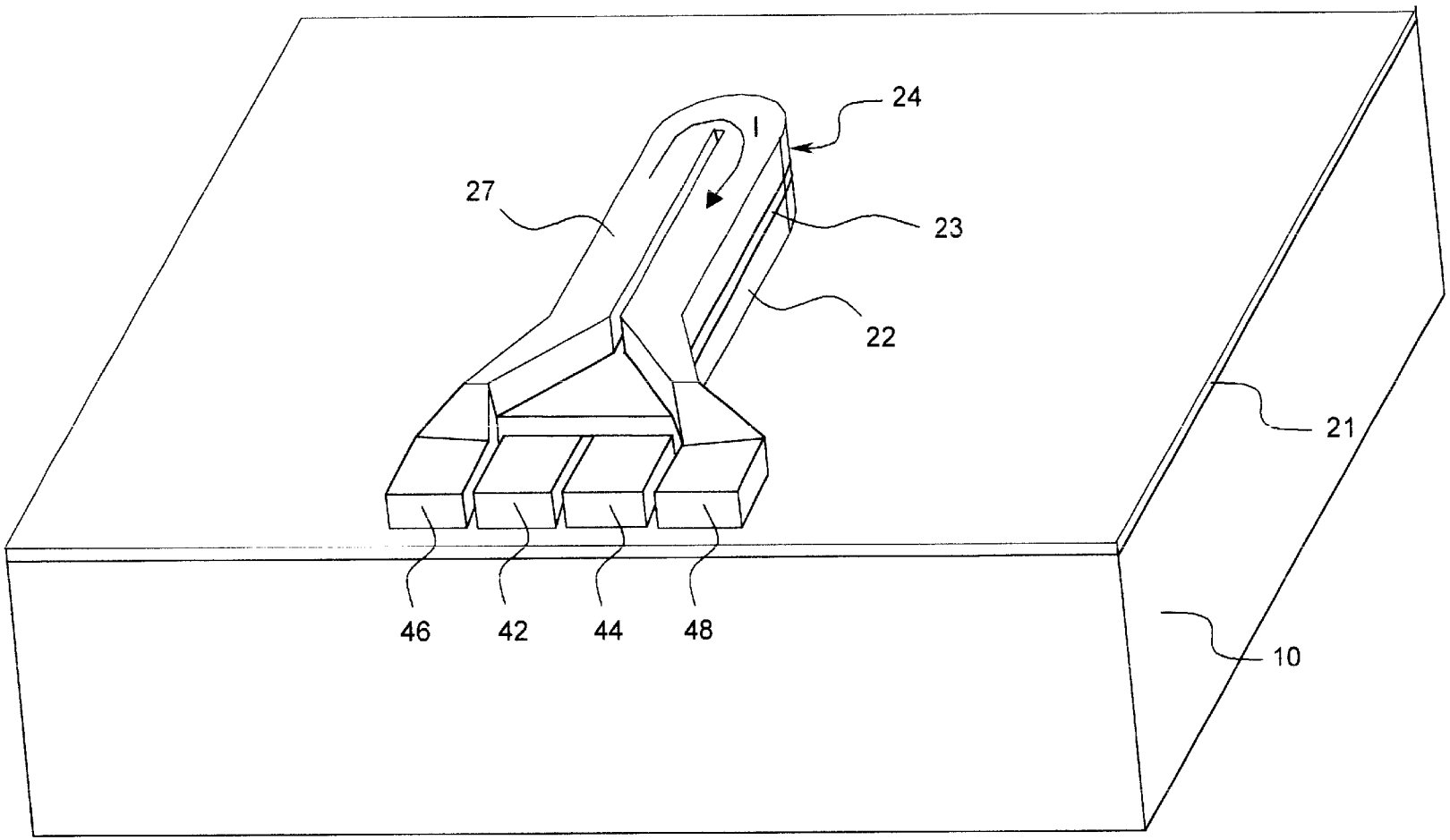
FIG. 7 is a perspective view of the next stages of the process illustrated in FIGS. 5 and 6 wherein a second deflector layer of the cantilevered element is formed.

FIG. 7 illustrates a second deflector layer 24 having been deposited and patterned over the previously formed barrier layer 23. A resistor portion 27 is patterned in second deflector layer 24. The current path is indicated by an arrow and letter "I". In the illustrated embodiment, a second pair of electrodes 46 and 48, for addressing resistor portion 27, are formed in the second deflector layer 24 material brought over the barrier layer 23 to contact positions on either side of the first pair of electrodes 42 and 44. Electrodes 46 and 48 may make contact with circuitry previously formed in substrate 10 or may be contacted externally by other standard electrical interconnection methods, such as tape automated bonding (TAB) or wire bonding.

In some preferred embodiments of the present invention, the same material, for example, intermetallic titanium aluminide, is used for both second deflector layer 24 and first deflector layer 22. In this case an intermediate masking step may be needed to allow patterning of the second deflector layer 24 shape without disturbing the previously delineated first deflector layer 22 shape. Alternately, barrier layer 23 may be fabricated using a lamination of two different materials, one of which is left in place protecting electrodes 42, 44 while patterning the second deflector layer 24, and then removed to result in the cantilever element intermediate structure illustrated in FIG. 7.

Additional passivation materials may be applied at this stage over the second deflector layer for chemical and electrical protection. Also, the initial passivation layer 21 is patterned away from areas through which fluid will pass from openings to be etched in substrate 10.

Figure 8:
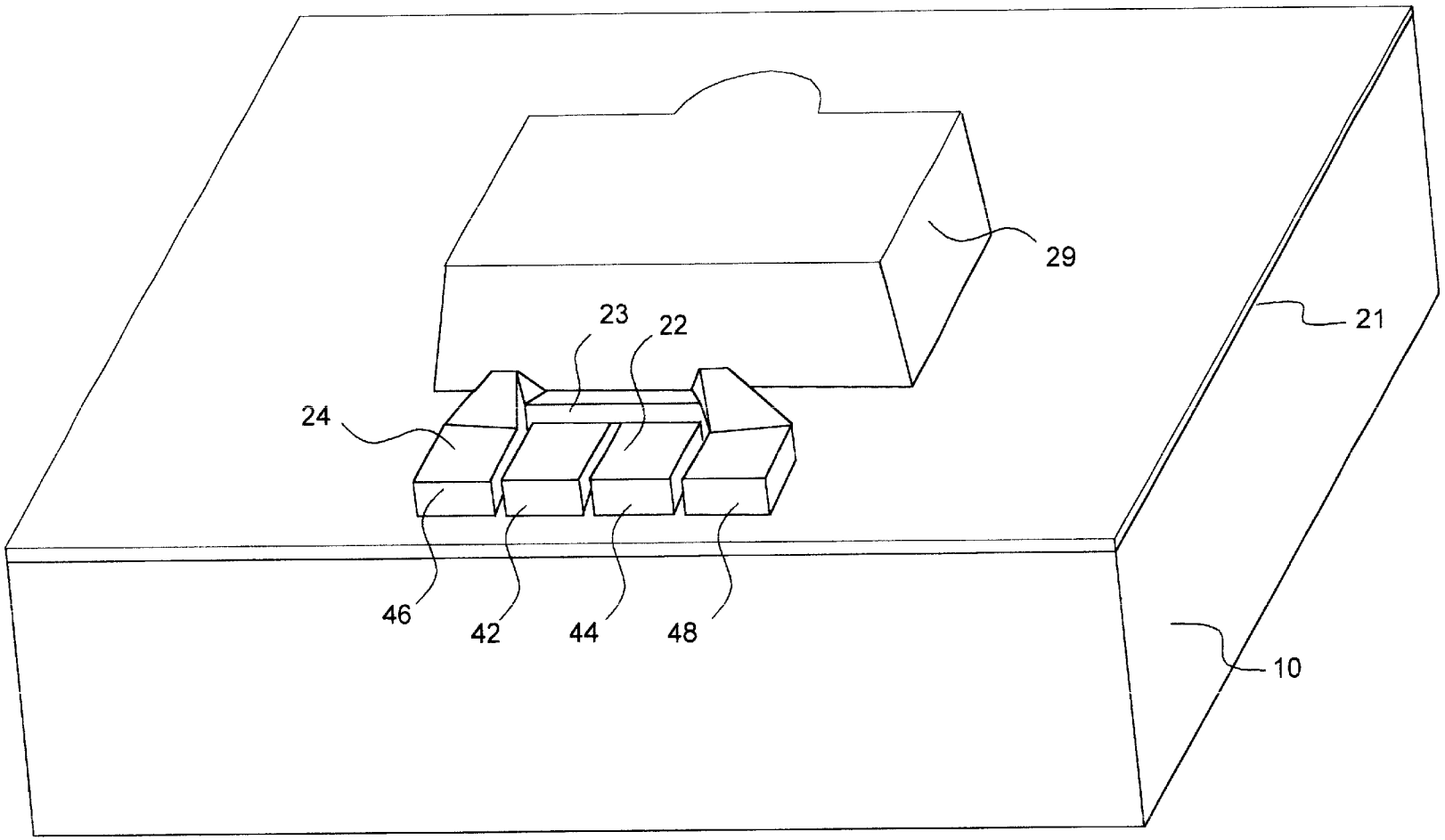
FIG. 8 is a perspective view of the next stages of the process illustrated in FIGS. 5–7 wherein a sacrificial layer in the shape of the liquid filling a chamber of a drop emitter according to the present invention is formed.

FIG. 8 shows the addition of a sacrificial layer 29 which is formed into the shape of the interior of a chamber of a liquid drop emitter. A suitable material for this purpose is polyimide. Polyimide is applied to the device substrate in sufficient depth to also planarize the surface which has the topography of the first deflector 22, barrier 23 and second deflector layers 24 as illustrated in FIG. 7. Any material which can be selectively removed with respect to the adjacent materials may be used to construct sacrificial structure 29.

Figure 9:
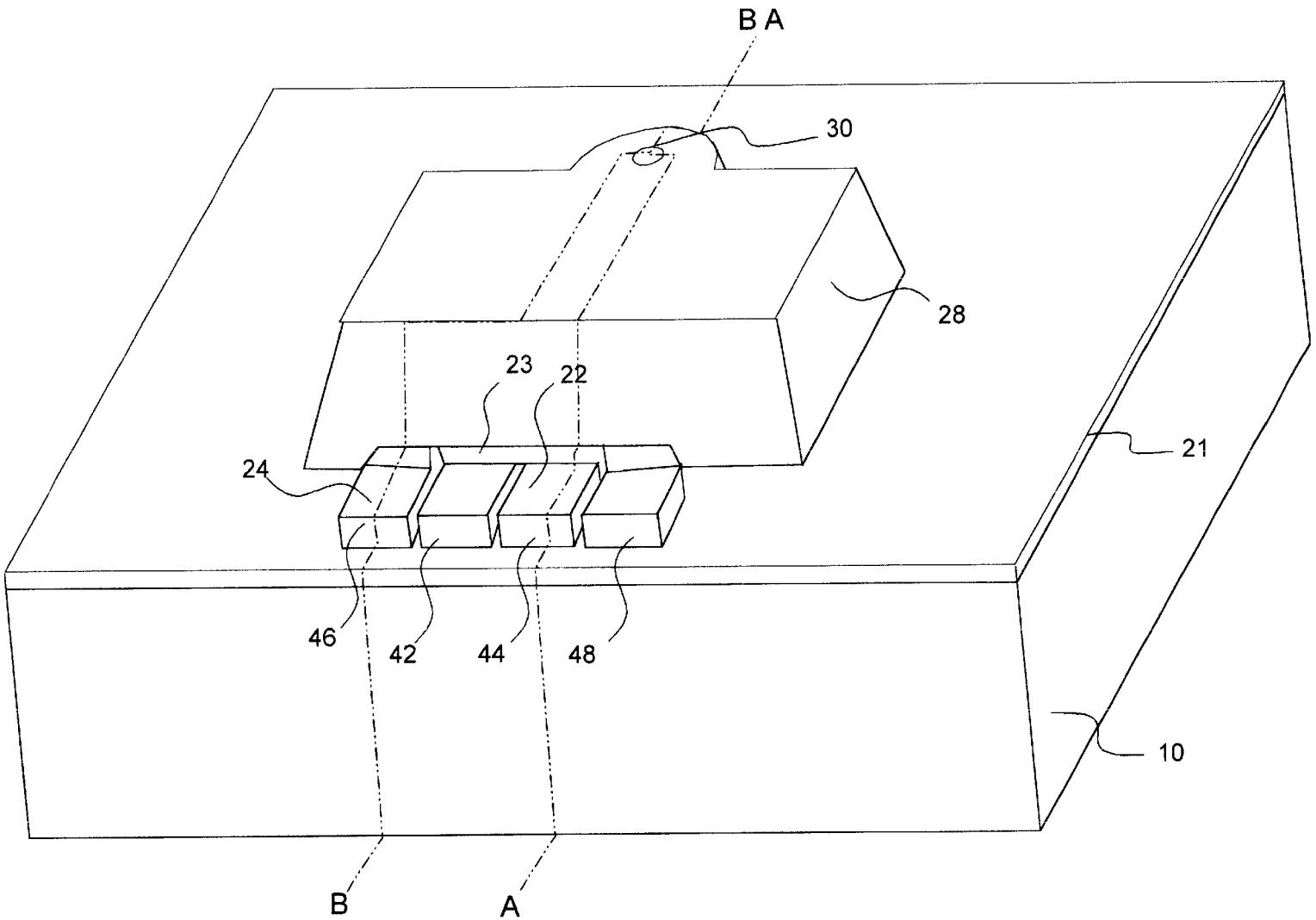
FIG. 9 is a perspective view of the next stages of the process illustrated in FIGS. 5–8 wherein a liquid chamber and nozzle of a drop emitter according to the present invention are formed.

FIG. 9 illustrates drop emitter liquid chamber walls and cover formed by depositing a conformal material, such as plasma deposited silicon oxide, nitride, or the like, over the sacrificial layer structure 29. This layer is patterned to form drop emitter chamber 28. Nozzle 30 is formed in the drop emitter chamber, communicating to the sacrificial material layer 29, which remains within the drop emitter chamber 28 at this stage of the fabrication sequence.

Figure 10A:
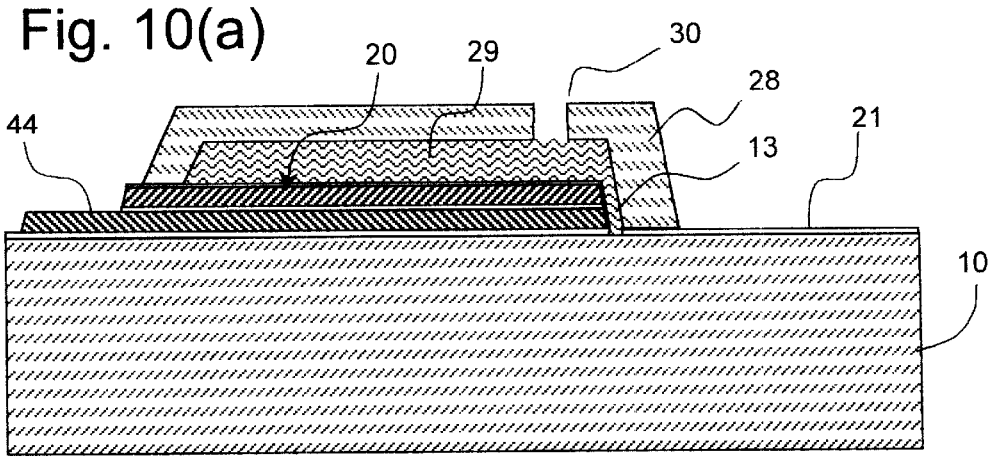
FIGS. 10(*a*), 10(*b*) and 10(*c*) is a side view of the final stages of the process illustrated in FIGS. 5–10 wherein a liquid supply pathway is formed and the sacrificial layer is removed to complete a liquid drop emitter according to the present invention.

FIG. 10 shows a side view of the device through a section indicated as A—A in FIG. 9. In FIG. 10*a* the sacrificial layer 29 is enclosed within the drop emitter chamber walls 28 except for nozzle opening 30. Also illustrated in FIG. 10*a*, the substrate 10 is intact. Passivation layer 21 has been removed from the surface of substrate 10 in gap area 13 and around the periphery of the cantilevered element 20. The removal of layer 21 in these locations was done at a fabrication stage before the forming of sacrificial structure 29.

Figure 10B:
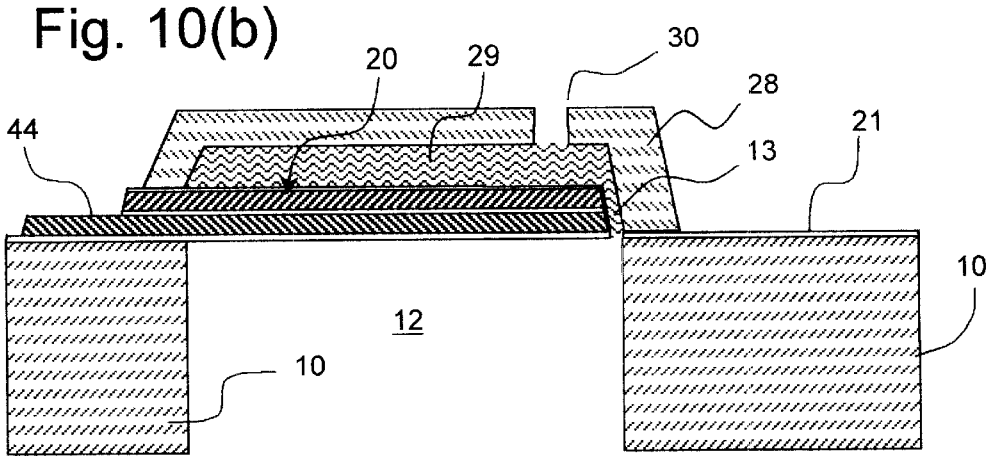

In FIG. 10*b*, substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon. For constructing a thermal actuator alone, the sacrificial structure and liquid chamber steps are not needed and this step of etching away substrate 10 may be used to release the cantilevered element.

Figure 10C:
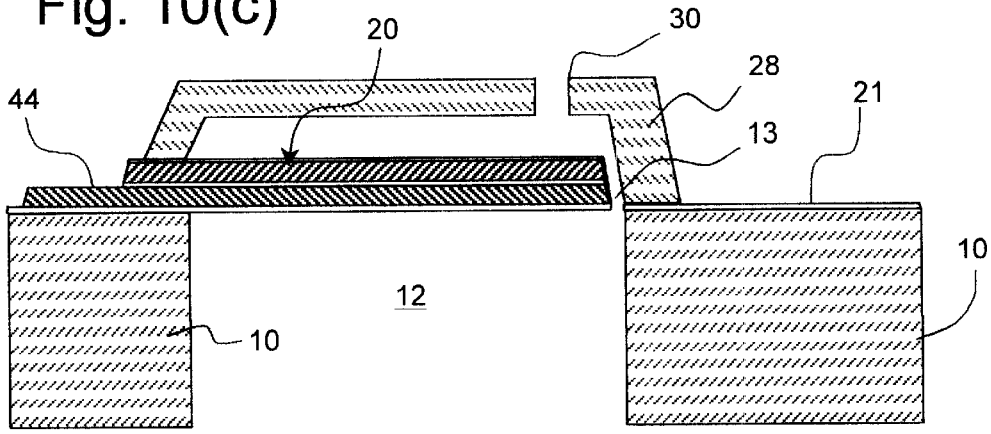

In FIG. 10*c* the sacrificial material layer 29 has been removed by dry etching using oxygen and fluorine sources. The etchant gasses enter via the nozzle 30 and from the newly opened fluid supply chamber area 12, etched previously from the backside of substrate 10. This step releases the cantilevered element 20 and completes the fabrication of a liquid drop emitter structure.

Figure 11:
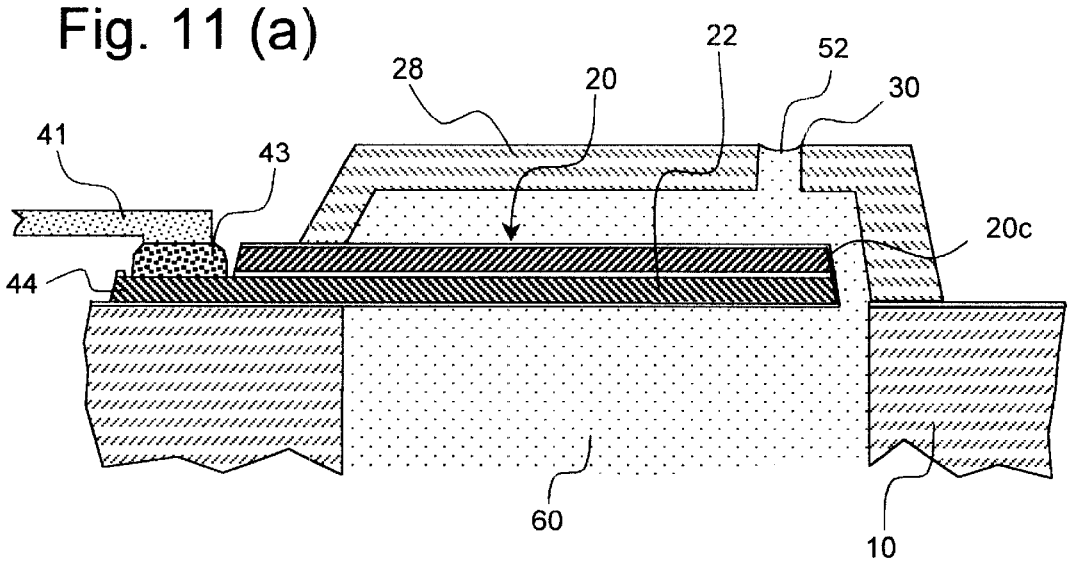
FIGS. 11(*a*) and 11(*b*) is a side view illustrating the application of an electrical pulse to the first pair of electrodes of a drop emitter according the present invention.
Figure 11:
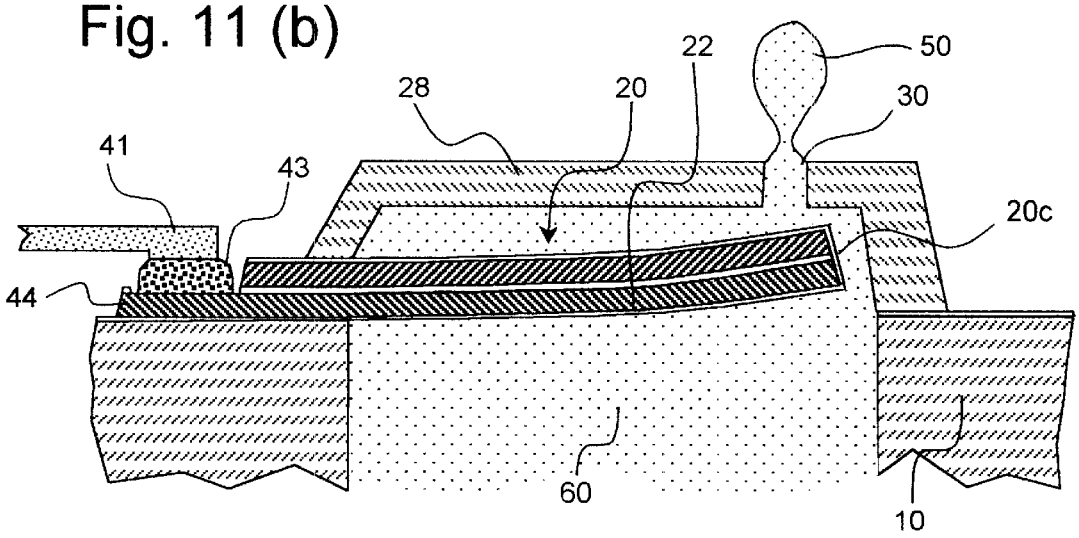

FIG. 11 illustrates a side view of a liquid drop emitter structure according to some preferred embodiments of the present invention. The side views of FIG. 11 are formed along a line indicated as A—A in FIG. 9. FIG. 11*a* shows the cantilevered element 20 in a first position proximate to nozzle 30. Liquid meniscus 52 rests at the outer rim of nozzle 30. FIG. 11*b* illustrates the deflection of the free end 20*c* of the cantilevered element 20 towards nozzle 30. The upward deflection of the cantilevered element is caused by applying an electrical pulse to the first pair of electrodes 42,44 attached to resistor portion 26 of the first deflector layer 22 (see also FIG. 3*b*). Rapid deflection of the cantilevered element to this second position pressurizes liquid 60, overcoming the meniscus pressure at the nozzle 30 and causing a drop 50 to be emitted.

Figure 12:
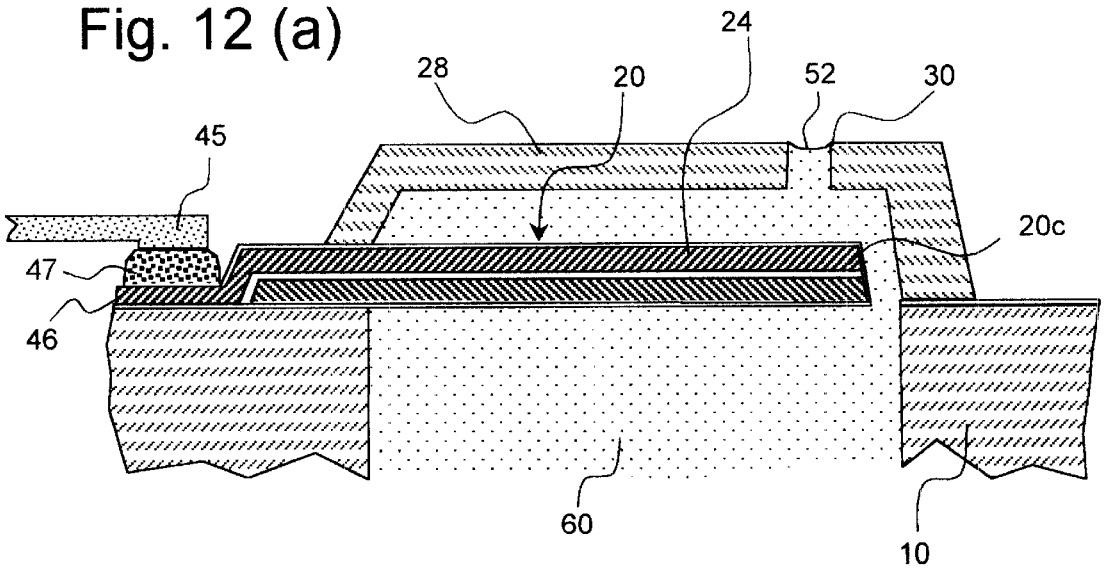
FIGS. 12(*a*) and 12(*b*) is a side view illustrating the application of an electrical pulse to the second pair of electrodes of a drop emitter according the present invention.
Figure 12:
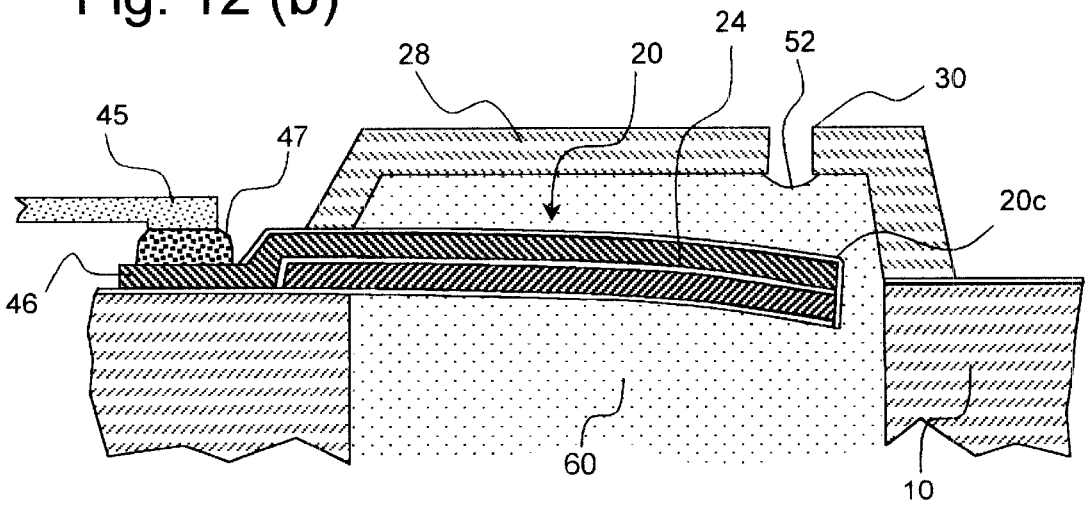

FIG. 12 illustrates a side view of a liquid drop emitter structure according to some preferred embodiments of the present invention. The side views of FIG. 12 are formed along a line indicated as B—B in FIG. 9. FIG. 12*a* shows the cantilevered element 20 in a first position proximate to nozzle 30. Liquid meniscus 52 rests at the outer rim of nozzle 30. FIG. 12*b* illustrates the deflection of the free end 20*c* of the cantilevered element 20 away from nozzle 30. The downward deflection of the cantilevered element is caused by applying an electrical pulse to the second pair of electrodes 46,48 attached to resistor portion 27 of the second deflector layer 24 (see also FIG. 3*b*). Deflection of the cantilevered element to this downward position negatively pressurizes liquid 60 in the vicinity of nozzle 30, causing meniscus 52 to be retracted to a lower, inner rim area of nozzle 30.

In an operating emitter of the cantilevered element type illustrated, the quiescent first position may be a partially bent condition of the cantilevered element 20 rather than the horizontal condition illustrated FIGS. 11*a* and 12*a*. The actuator may be bent upward or downward at room temperature because of internal stresses that remain after one or more microelectronic deposition or curing processes. The device may be operated at an elevated temperature for various purposes, including thermal management design and ink property control. If so, the first position may be substantially bent.

For the purposes of the description of the present invention herein, the cantilevered element will be said to be quiescent or in its first position when the free end is not significantly changing in deflected position. For ease of understanding, the first position is depicted as horizontal in FIGS. 4*a*, 11*a*, 12*a*, and 18*a*. However, operation of thermal actuators about a bent first position are known and anticipated by the inventors of the present invention and are fully within the scope of the present inventions.

FIGS. 5 through 10 illustrate a preferred fabrication sequence. However, many other construction approaches may be followed using well known microelectronic fabrication processes and materials. For the purposes of the present invention, any fabrication approach which results in a cantilevered element including a first deflection layer 22, a barrier layer 23, and a second deflector layer 24 may be followed. Further, in the illustrated sequence of FIGS. 5 through 10, the liquid chamber 28 and nozzle 30 of a liquid drop emitter were formed in situ on substrate 10. Alternatively a thermal actuator could be constructed separately and bonded to a liquid chamber component to form a liquid drop emitter.

Figure 13:
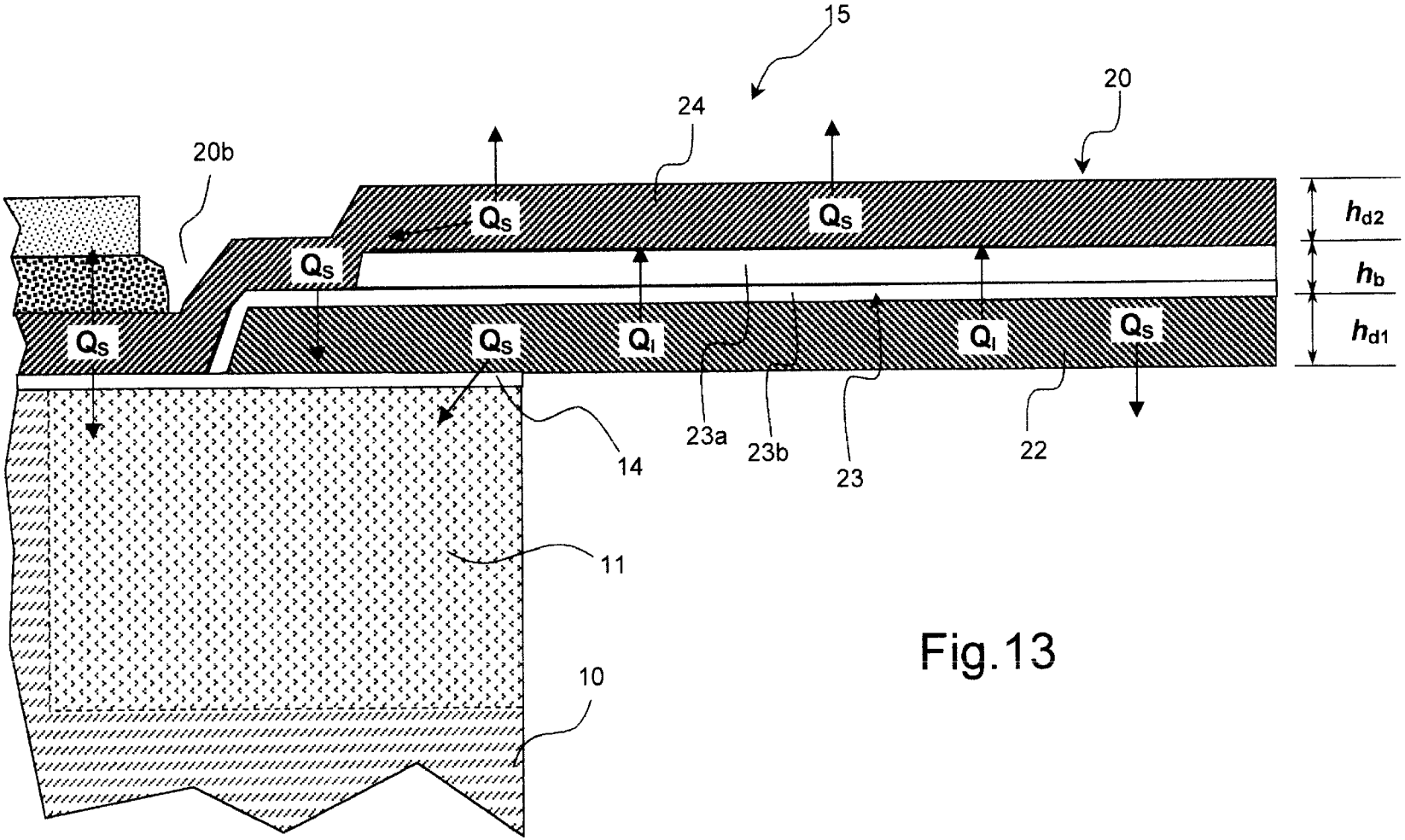
FIG. 13 is a side view illustrating heat flows within and out of a cantilevered element according to the present invention.

The flow of heat within cantilevered element 20 is a primary physical process underlying the present inventions. FIG. 13 illustrates heat flows by means of arrows designating internal heat flow, $Q_I$, and flow to the surroundings, $Q_S$. Cantilevered element 20 bends, deflecting free end 20*c*, because first deflector layer 22 is made to elongate with respect to second deflector layer 24 by the addition of a heat pulse to first deflector layer 22, or vice versa. In general, thermal actuators of the cantilever configuration may be designed to have large differences in the coefficients of thermal expansion at a uniform operating temperature, to operate with a large temperature differential within the actuator, or some combination of both. The present inventions are designed to utilize and maximize an internal temperature differential set up between the first deflector layer 22 and second deflector layer 24.

In the preferred embodiments, the first deflector layer 22 and second deflector layer 24 are constructed using materials having substantially equal coefficients of thermal expansion over the temperature range of operation of the thermal actuator. Therefore, maximum actuator deflection occurs when the maximum temperature difference between the first deflector layer 22 and second deflector layer 24 is achieved. Restoration of the actuator to a first or nominal position then will occur when the temperature equilibrates among first deflector layer 22, second deflector layer 24 and barrier layer 23. The temperature equilibration process is mediated by the characteristics of the barrier layer 23, primarily its thickness, Young's modulus, coefficient of thermal expansion and thermal conductivity.

The temperature equilibration process may be allowed to proceed passively or heat may be added to the cooler layer. For example, if first deflector layer 22 is heated first to cause a desired deflection, then second deflector layer 24 may be heated subsequently to bring the overall cantilevered element into thermal equilibrium more quickly. Depending on the application of the thermal actuator, it may be more desirable to restore the cantilevered element to the first position even though the resulting temperature at equilibrium will be higher and it will take longer for the thermal actuator to return to an initial starting temperature.

As has been previously stated, for the purposes of the present inventions, it is desirable that the second deflector layer 24 mechanically balance the first deflector layer 22 when internal thermal equilibrium is reached following a heat pulse which initially heats first deflector layer 22. Mechanical balance at thermal equilibrium is achieved by the design of the thickness and the materials properties of the layers of the cantilevered element, especially the coefficients of thermal expansion and Young's moduli. The full analysis of the thermomechanical effects is very complex for the situation of arbitrary values for all of the parameters of a tri-layer cantilevered element. The present invention may be understood by considering the net deflection for a tri-layer beam structure at an equilibrium temperature.

A cantilevered tri-layer structure comprised of first deflector, barrier and second deflector layers having different materials properties and thickness, generally assumes a parabolic arc shape at an elevated temperature. The deflection D of the free end of the cantilever, as a function of temperature above a base temperature $\Delta T$, is proportional to the materials properties and thickness according to the following relationships:

$$D \propto M\Delta T, \tag{1}$$

$$\text{where, } M = \frac{1}{G}\left\{E_{d1}(\alpha-\alpha_{d1})\left[\left(\frac{h_b}{2}\right)^2-\left(\frac{h_b}{2}+h_{d1}\right)^2\right]+\left(E_{d2}(\alpha-\alpha_{d2})\left[\left(\frac{h_b}{2}+h_{d2}\right)^2-\left(\frac{h_b}{2}\right)^2\right]\right\}\right. \tag{2}$$

$$\text{and} \quad \alpha = \frac{E_{d1}\alpha_{d1}h_{d1}+E_b\alpha_b h_b+E_{d2}\alpha_{d2}h_{d2}}{E_{d1}h_{d1}+E_b h_b+E_{d2}h_{d2}}. \tag{3}$$

The subscripts d1, b and d2 refer to the first deflector, barrier and second deflector layers, respectively. $E_j$, $\alpha$, and $h_j$ (j=d1, b, or d2) are the Young's modulus, coefficient of thermal expansion and thickness, respectively, for the $j^{th}$ layer. The parameter G is a function of the elastic parameters and dimensions of the various layers and is always a positive quantity. Exploration of the parameter G is not needed for determining when the tri-layer beam could have a net zero deflection at an elevated temperature for the purpose of understanding the present inventions.

The important quantity M in Equations 1 and 2 captures effects of materials properties and thickness of the layers. The tri-layer cantilever will have a net zero deflection, D=0, for an elevated value of $\Delta T$, if M=0. Examining Equation 2 the condition M=0 occurs when:

$$E_{d1}(\alpha-\alpha_{d1})\left[\left(\frac{h_b}{2}\right)^2-\left(\frac{h_b}{2}+h_{d1}\right)^2\right] = E_{d2}(\alpha-\alpha_{d2})\left[\left(\frac{h_b}{2}\right)^2-\left(\frac{h_b}{2}+h_{d2}\right)^2\right]. \tag{4}$$

For the special case when layer thickness, $h_{d1}=h_{d2}$, coefficients of thermal expansion, $\alpha_{d1}=\alpha_{d2}$, and Young's moduli, $E_{d1}=E_{d2}$, the quantity M is zero and there is zero net deflection, even at an elevated temperature, i.e. $\Delta T \neq 0$.

It may be understood from Equation 2 that if the second deflector layer 24 material is the same as the first deflector layer 22 material, then the tri-layer structure will have a net zero deflection if the thickness $h_{d1}$ of first deflector layer 22 is substantially equal to the thickness $h_{d2}$ of second deflector layer 24.

It may also be understood from Equation 2 there are many other combinations of the parameters for the second deflector layer 24 and barrier layer 23 which may be selected to provide a net zero deflection for a given first deflector layer 22. For example, some variation in second deflector layer 24 thickness, Young's modulus, or both, may be used to compensate for different coefficients of thermal expansion between second deflector layer 24 and first deflector layer 22 materials.

All of the combinations of the layer parameters captured in Equations 1–4 that lead to a net zero deflection for the tri-layer structure at an elevated temperature $\Delta T$ are anticipated by the inventors of the present inventions as viable embodiments of the present inventions.

The internal heat flows $Q_I$ illustrated in FIG. 13 are driven by the temperature differential among layers. For the purpose of understanding the present inventions, heat flow from a first deflector layer 22 to a second deflector layer 24 may be viewed as a heating process for the second deflector layer 24 and a cooling process for the first deflector layer 22. Barrier layer 23 may be viewed as establishing a time constant, $\tau_B$, for heat transfer in both heating and cooling processes.

The time constant $\tau_B$ is approximately proportional to the thickness $h_b$ of the barrier layer 23 and inversely proportional to the thermal conductivity of the materials used to construct this layer. As noted previously, the heat pulse input to first deflector layer 22 must be shorter in duration than the heat transfer time constant, otherwise the potential temperature differential and deflection magnitude will be dissipated by excessive heat loss through the barrier layer 23.

A second heat flow ensemble, from the cantilevered element to the surroundings, is indicated by arrows marked $Q_S$. The details of the external heat flows will depend importantly on the application of the thermal actuator. Heat may flow from the actuator to substrate 10, or other adjacent structural elements, by conduction. If the actuator is operating in a liquid or gas, it will lose heat via convection and conduction to these fluids. Heat will also be lost via radiation. For purpose of understanding the present inventions, heat lost to the surrounding may be characterized as a single external cooling time constant $\tau_S$ which integrates the many processes and pathways that are operating.

Another timing parameter of importance is the desired repetition period, $\tau_C$, for operating the thermal actuator. For example, for a liquid drop emitter used in an ink jet printhead, the actuator repetion period establishes the drop firing frequency, which establishes the pixel writing rate that a jet can sustain. Since the heat transfer time constant $\tau_B$ governs the time required for the cantilevered element to restore to a first position, it is preferred that $\tau_B \ll \tau_C$ for energy efficiency and rapid operation. Uniformity in actuation performance from one pulse to the next will improve as the repetition period $\tau_C$ is chosen to be several units of $\tau_B$ or more. That is, if $\tau_C > 5\tau_B$ then the cantilevered element will have fully equilibrated and returned to the first or nominal position. If, instead $\tau_C < 2\tau_B$, then there will be some significant amount of residual deflection remaining when a next deflection is attempted. It is therefore desirable that $\tau_C > 2\tau_B$ and more preferably that $\tau_C > 4\tau_B$.

The time constant of heat transfer to the surround, $\tau_S$, may influence the actuator repetition period, $\tau_C$, as well. For an efficient design, $\tau_S$ will be significantly longer than $\tau_B$. Therefore, even after the cantilevered element has reached internal thermal equilibrium after a time of 3 to 5 $\tau_B$, the cantilevered element will be above the ambient temperature or starting temperature, until a time of 3 to 5 $\tau_S$. A new deflection may be initiated while the actuator is still above ambient temperature. However, to maintain a constant amount of mechanical actuation, higher and higher peak temperatures for the layers of the cantilevered element will be required. Repeated pulsing at periods $\tau_C < 3\tau_S$ will cause continuing rise in the maximum temperature of the actuator materials until some failure mode is reached.

A heat sink portion 11 of substrate 10 is illustrated in FIG. 13. When a semiconductor or metallic material such as silicon is used for substrate 10, the indicated heat sink portion 11 may be simply a region of the substrate 10 designated as a heat sinking location. Alternatively, a separate material may be included within substrate 10 to serve as an efficient sink for heat conducted away from the cantilevered element 20 at the anchor portion 20*b*.

Figure 14:
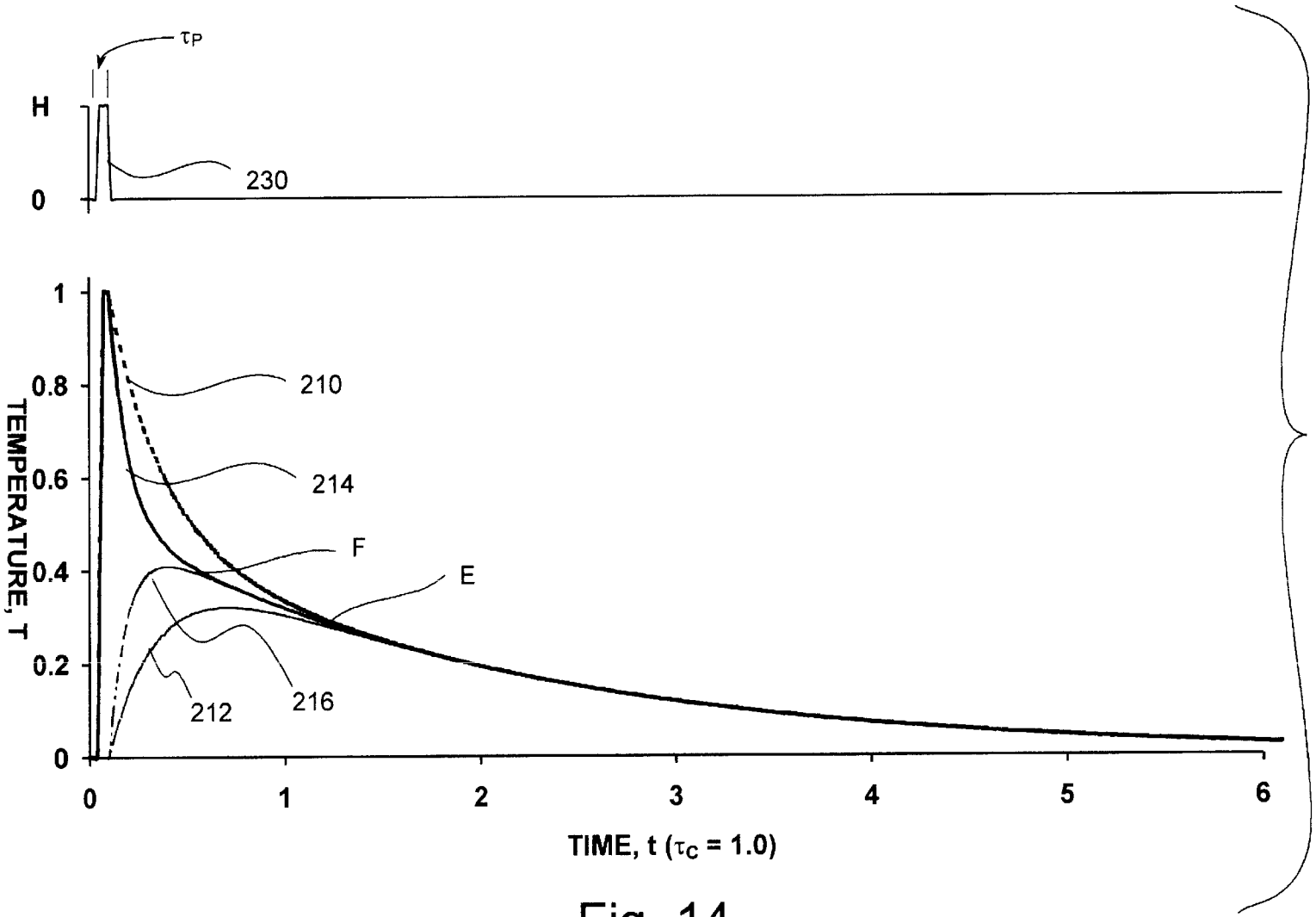
FIG. 14 is a plot of temperature versus time for deflector and second deflector layers for two configurations of the barrier layer of a cantilevered element according to the present invention.

FIG. 14 illustrates the timing of heat transfers within the cantilevered element 20 and from the cantilevered 20 to the surrounding structures and materials. Temperature, T, is plotted on a scale normalized over the intended range of temperature excursion of the first deflector layer 22 above its steady state operating temperature. That is, T=1 in FIG. 14 is the maximum temperature reached by the first deflector layer after a heat pulse has been applied and T=0 in FIG. 14 is the base or steady state temperature of the cantilevered element. The time axis of FIG. 14 is plotted in units of $\tau_C$, the minimum time period for repeated actuations. Also illustrated in FIG. 14 is a single heating pulse 230 having a pulse duration time of $\tau_P$. Heating pulse 230 is applied to first deflector layer 22.

FIG. 14 shows four plots of temperature, T, versus time, t. Curves for the second deflector layer 24 and for the first deflector layer 22 are plotted for cantilevered element configurations having two different values of the heat transfer time constant $\tau_B$. A single value for the heat transfer time constant, $\tau_S$, was used for all four temperature curves. One-dimensional, exponential heating and cooling functions are assumed to generate the temperature versus time plots of FIG. 14.

In FIG. 14, curve 210 illustrates the temperature of the first deflector layer 22 and curve 212 illustrates the temperature of the second deflector layer 24 following a heat pulse applied to the first deflector layer 22. For curves 210 and 212, the barrier layer 23 heat transfer time constant is $\tau_B = 0.3\tau_C$ and the time constant for cooling to the surround, $\tau_S = 2.0\tau_C$. FIG. 14 shows the second deflector layer 24 temperature 212 rising as the first deflector layer 22 temperature 210 falls, until internal equilibrium is reached at the point denoted E. After point E, the temperature of both layers 22 and 24 continues to decline together at a rate governed by $\tau_S = 2.0\tau_C$. The amount of deflection of the cantilevered element is approximately proportional to the difference between first deflector layer temperature 210 and second deflector layer temperature 212. Hence, the cantilevered element will be restored from its deflected position to the first position at the time and temperature denoted as E in FIG. 14.

The second pair of temperature curves, 214 and 216, illustrate the first deflector layer temperature and second deflector layer temperature, respectively, for the case of a shorter barrier layer time constant, $\tau_B = 0.1\tau_C$. The surround cooling time constant for curves 214 and 216 is also $\tau_S = 2.0\tau_C$ as for curves 210 and 212. The point of internal thermal equilibrium within cantilevered element 20 is denoted F in FIG. 14. Hence, the cantilevered element will be restored from its deflection position to the first position at the time and temperature denoted as F in FIG. 14.

It may be understood from the illustrative temperature plots of FIG. 14 that it is advantageous that $\tau_B$ is small with respect to $\tau_C$ in order that the cantilevered element is restored to its first or nominal position before a next actuation is initiated. If a next actuation were initiated at time $t=1.0\tau_C$, it can be understood from equilibrium points E and F that the cantilevered element would be fully restored to its first position when $\tau_B=0.1\tau_C$. If $\tau_B=0.3\tau_C$, however, it would be starting from a somewhat deflected position, indicated by the small temperature difference between curves 210 and 212 at time $t=1.0\tau_C$.

FIG. 14 also illustrates that the cantilevered element 20 will be at an elevated temperature even after reaching internal thermal equilibrium and restoration of the deflection to the first position. The cantilevered element 20 will be elongated at this elevated temperature but not deflected due to a balance of forces between the first deflector layer 22 and second deflector layer 24. The cantilevered element may be actuated from this condition of internal thermal equilibrium at an elevated temperature. However, continued application of heat pulses and actuations from such elevated temperature conditions may cause failure modes to occur as various materials in the device or working environment begin to occur as peak temperature excursions also rise. Consequently, it is advantageous to reduce the time constant of heat transfer to the surround, $\tau_S$, as much as possible.

In operating the thermal actuators according to the present inventions, it is advantageous to select the electrical pulsing parameters with recognition of the heat transfer time constant, $\tau_B$, of the barrier layer 23. Once designed and fabricated, a thermal actuator having a cantilevered design according to the present inventions, will exhibit a characteristic time constant, $\tau_B$, for heat transfer between first deflector layer 22 and second deflector layer 24 through barrier layer 23. For efficient energy use and maximum deflection performance, heat pulse energy is applied over a time which is short compared to the internal energy transfer process characterized by $\tau_B$. Therefore it is preferable that applied heat energy or electrical pulses for electrically resistive heating have a duration of $\tau_P$, where $\tau_P<\tau_B$ and, preferably, $\tau_P<\frac{1}{2}\tau_B$.

The thermal actuators of the present invention allow for active deflection on the cantilevered element 20 in substantially opposing motions and displacements. By applying an electrical pulse to heat the first deflector layer 22, the cantilevered element 20 deflects in a direction away from first deflector layer 22 (see FIGS. 4*b* and 11*b*). By applying an electrical pulse to heat the second deflector layer 24, the cantilevered element 20 deflects in a direction away from the second deflector layer 24 and towards the first deflector layer 22 (see FIGS. 4*c* and 12*b*). The thermo-mechanical forces that cause the cantilevered element 20 to deflect become balanced if internal thermal equilibrium is then allowed to occur via internal heat transfer, for cantilevered elements 20 designed to satisfy above Equation 4.

In addition to the passive internal heat transfer and external cooling processes, the cantilevered element 20 also responds to passive internal mechanical forces arising from the compression or tensioning of the unheated layer materials. For example, if the first deflector layer 22 is heated causing the cantilevered element 20 to bend, the barrier layer 23 and second deflector layer 24 are mechanically compressed. The mechanical energy stored in the compressed materials leads to an opposing spring force which counters the bending, hence counters the deflection. Following a thermo-mechanical impulse caused by suddenly heating one of the deflector layers, the cantilevered element 20 will move in an oscillatory fashion until the stored mechanical energy is dissipated, in addition to the thermal relaxation processes previously discussed.

Figure 15:
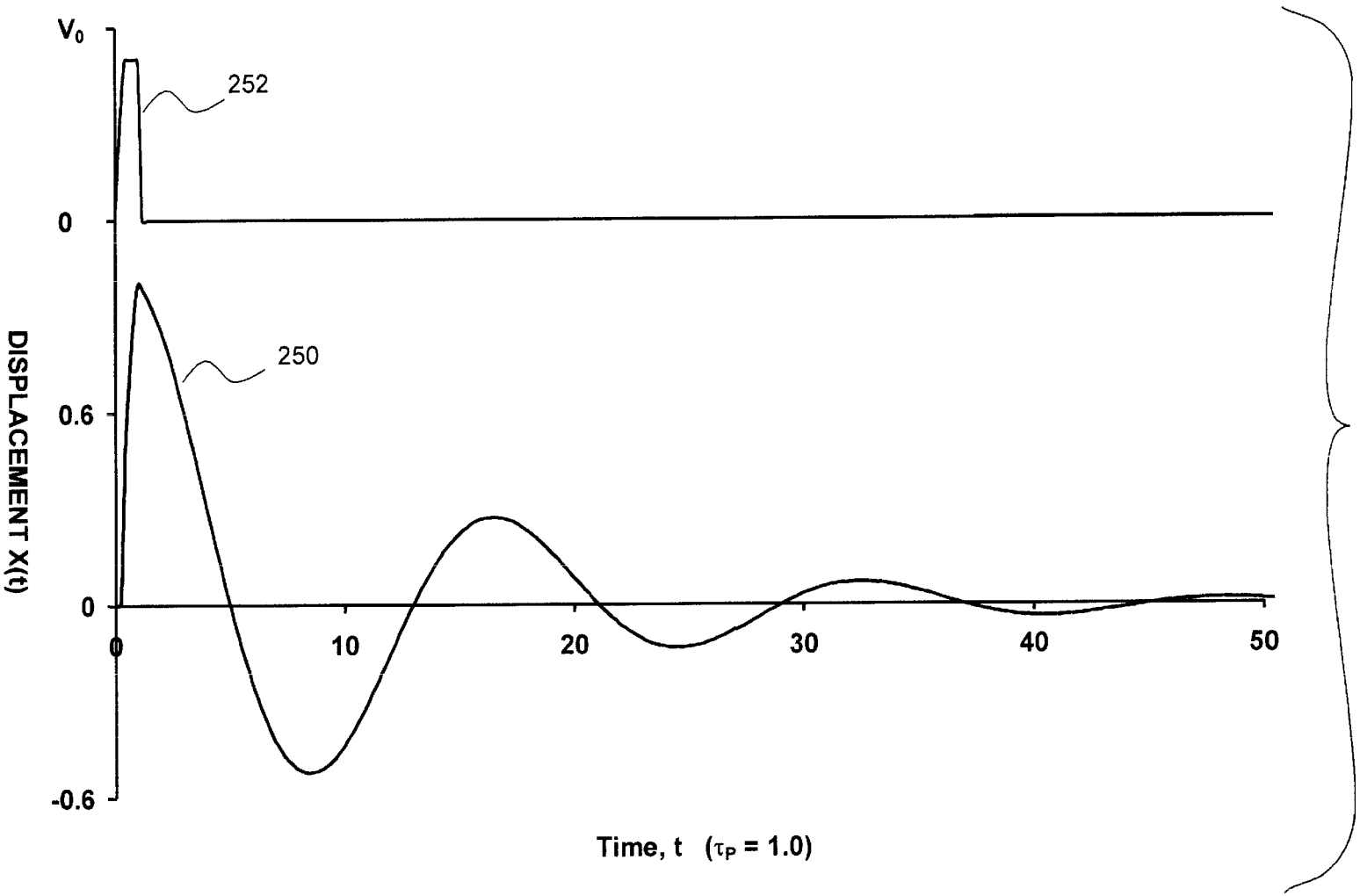
FIG. 15 is an illustration of damped resonant oscillatory motion of a cantilevered beam subjected to a deflection impulse.

FIG. 15 illustrates the damped oscillatory behavior of a cantilevered element. Plot 250 shows the displacement of the free end 20*c* of a cantilevered element as a function of time. Plot 252 shows the electrical pulse which generates the initial thermo-mechanical impulse force that starts the damped oscillatory displacement. The time duration of the electrical pulse, $\tau_{P1}$, is assumed to be less than one-half the internal heat transfer time constant $\tau_B$, discussed previously. The time axis in FIG. 15 is plotted in units of $\tau_{P1}$. Plot 250 of cantilevered element free end displacement illustrates a case wherein the resonant period of oscillation $\tau_R\sim16\tau_{P1}$ and the damping time constant $\tau_D\sim8\tau_{P1}$. It may be understood from FIG. 15 that the resultant motion of a cantilevered element 20, which is subjected to thermo-mechanical impulses via both the first and second deflector layers 22 and 24 will be a combination of both the actively applied thermo-mechanical forces as well as the internal thermal and mechanical effects.

A desirable predetermined displacement versus time profile may be constructed utilizing the parameters of applied electrical pulses, especially the energies and time duration's, the waiting time $\tau_{W1}$ between applied pulses, and the order in which first and second deflector layers are addressed. The damped resonant oscillatory motion of a cantilevered element 20, as illustrated in FIG. 15, generates displacements on both sides of a quiescent or first position in response to a single thermo-mechanical impulse. A second, opposing, thermo-mechanical impulse may be timed, using $\tau_{W1}$, to amplify, or to further dampen, the oscillation begun by the first impulse.

Figure 16:
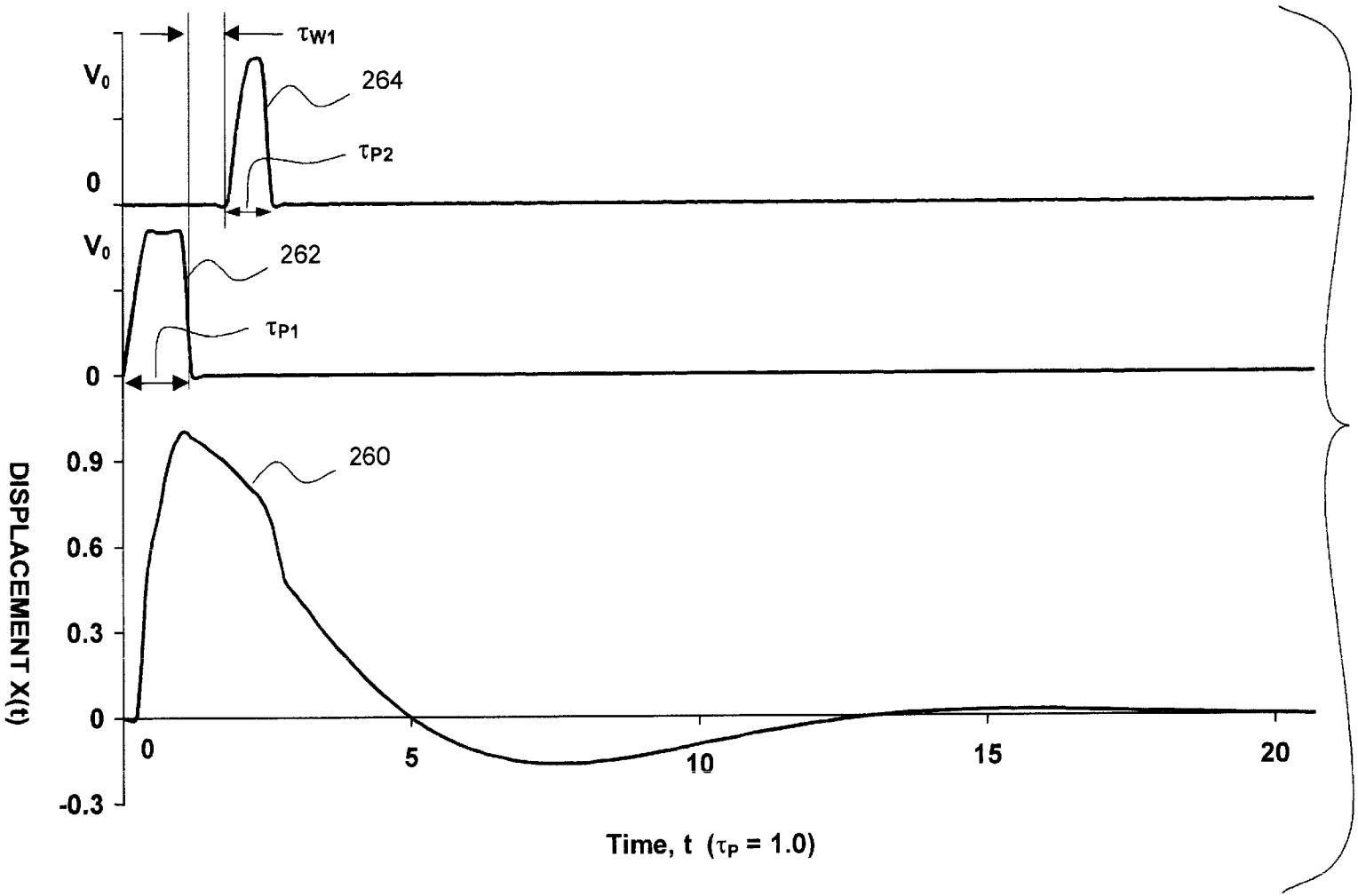
FIG. 16 is an illustration of some alternate applications of electrical pulses to affect the displacement versus time of a thermal actuator according to the present invention.

An activation sequence which serves to promote more rapid dampening and restoration to the first position is illustrated by plots 260, 262 and 264 in FIG. 16. The same characteristics $\tau_B$, $\tau_R$, and $\tau_D$ of the cantilevered element 20 used to plot the damped oscillatory motion shown in FIG. 15 are used in FIG. 16 as well. Plot 260 indicates the cantilevered element deflecting rapidly in response to an electrical pulse applied to the pair of electrodes attached to the resistor portion 26 of the first deflector layer 22. This first electrical pulse is illustrated as plot 262. The pulse duration $\tau_{P1}$, is the same as was used in FIG. 15 and the time axis of the plots in FIG. 16 are in units of $\tau_{P1}$. The initial deflection of cantilevered element 20 illustrated by plot 260 is therefore the same as for plot 250 in FIG. 15.

After a short waiting time, $\tau_{W1}$, a second electrical pulse is applied to the pair of electrodes attached to the resistor portion 27 of the second deflector layer 22, as illustrated by plot 264 in FIG. 16. The energy of this second electrical pulse is chosen so as to heat the second deflector layer 24 and raise its temperature to nearly that of the first deflector layer 22 at that point in time. In the illustration of FIG. 16, the second electrical pulse 264 is shown as having the same amplitude as the first electrical pulse 262, but has a shorter time duration, $\tau_{P2}<\tau_{P1}$. Heating the second deflector layer in this fashion elongates the second deflector layer, releasing the compressive stored energy and balancing the forces causing the cantilevered element 20 to bend. Hence, the second electrical pulse applied to second deflector layer 24 has the effect of quickly damping the oscillation of the cantilevered element 20 and restoring it to the first position.

Applying a second electrical pulse for the purpose of more quickly restoring the cantilevered element 20 to the first position has the drawback of adding more heat energy overall to the cantilevered element. While restored in terms of deflection, the cantilevered element will be at an even higher temperature. More time may be required for it to cool back to an initial starting temperature from which to initiate another actuation.

Active restoration using a second actuation may be valuable for applications of thermal actuators wherein minimization of the duration of the initial cantilevered element deflection is important. For example, when used to activate liquid drop emitters, actively restoring the cantilevered element to a first position may be used to hasten the drop break off process, thereby producing a smaller drop than if active restoration was not used. By initiating the retreat of cantilevered element 20 at different times (by changing the waiting time $\tau_{W1}$) different drop sizes may be produced.

Figure 17:
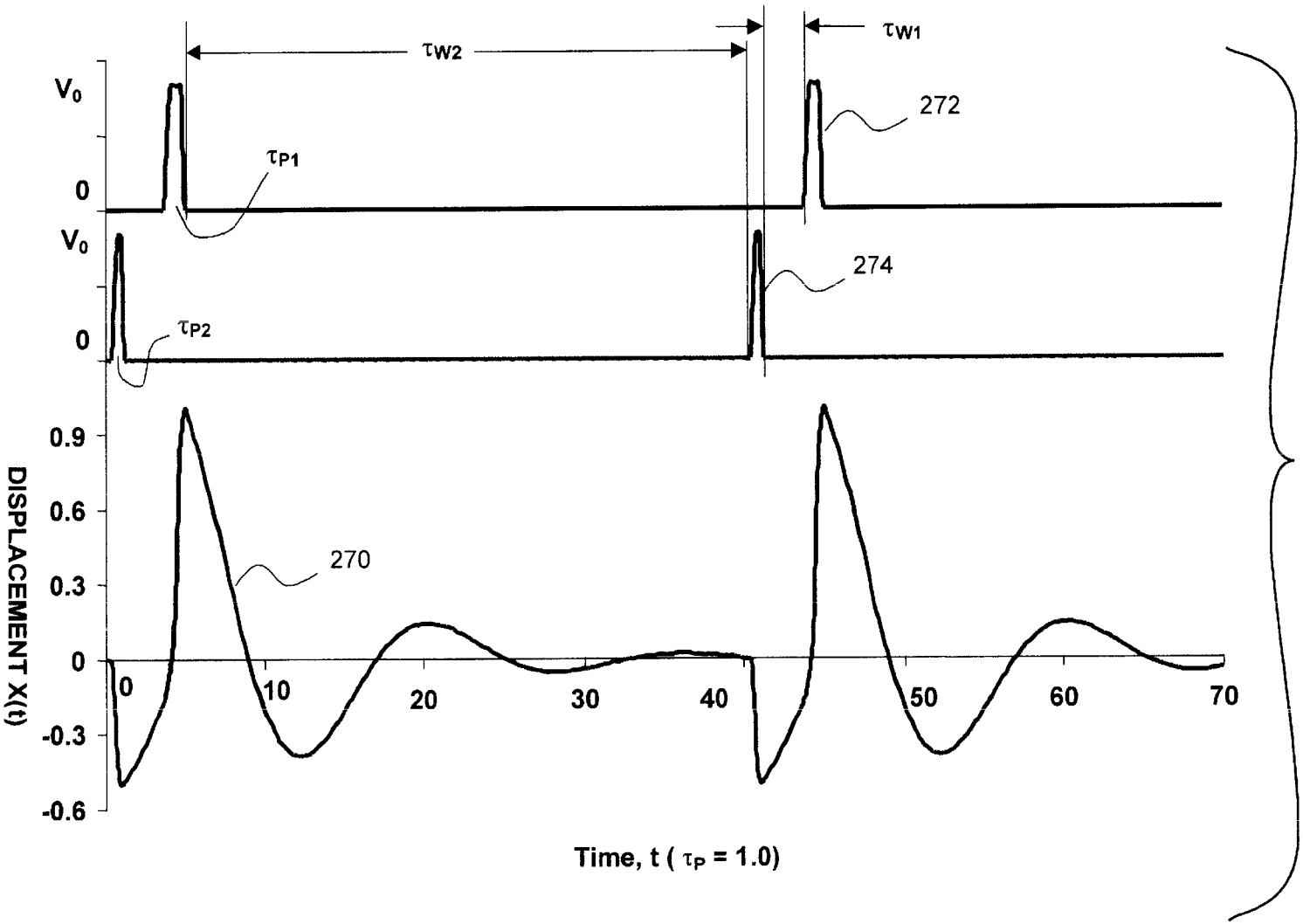
FIG. 17 is an illustration of some alternate applications of electrical pulses to affect the characteristics of drop emission according to the present invention.
Figure 18:
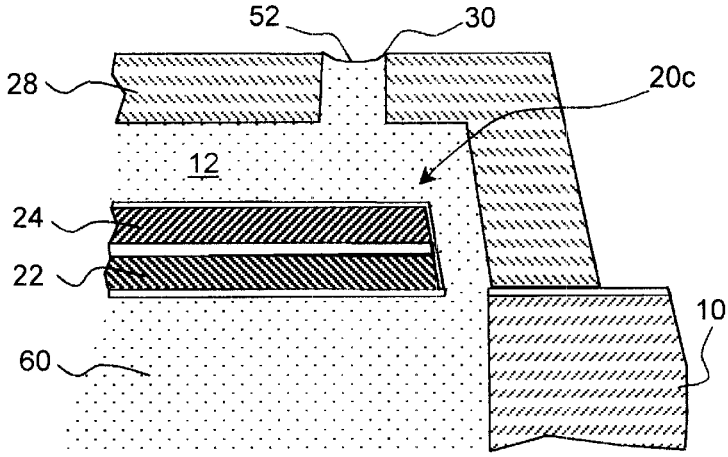
FIGS. 18(*a*), 18(*b*) and 18(*c*) is a side view illustrating the application of an electrical pulse to the second pair and then to the first pair of electrodes to cause drop emission according to the present.
Figure 18:
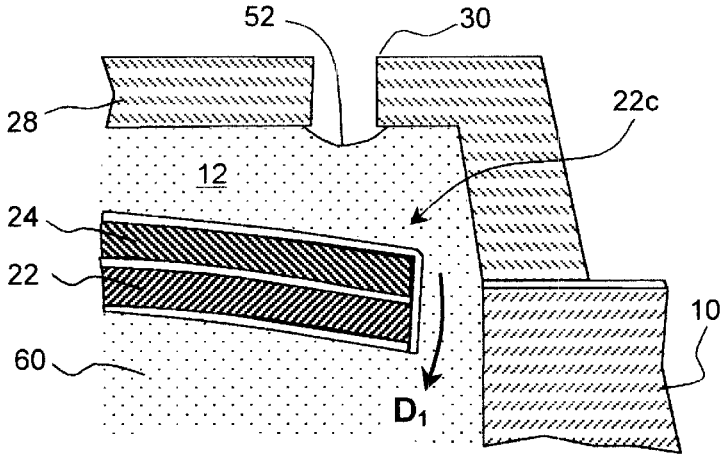
Figure 18:
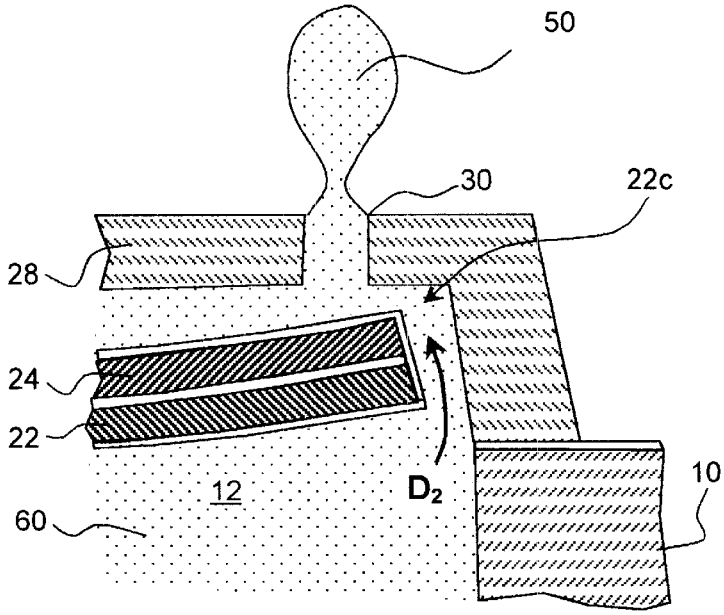

An activation sequence that serves to alter liquid drop emission characteristics by pre-setting the conditions of the liquid and liquid meniscus in the vicinity of the nozzle 30 of a liquid drop emitter is illustrated in FIG. 17. The conditions produced in the nozzle region of the liquid drop emitter are further illustrated in FIG. 18. Plot 270 illustrates the deflection versus time of the cantilevered element free end 20*c*, plot 272 illustrates an electrical pulse sequence applied to the first pair of electrodes addressing the first deflector layer 22 and plot 274 illustrates an electrical pulse sequence applied to the second pair of electrodes attached to the second deflector layer 24. The same cantilevered element characteristics $\tau_B$, $\tau_R$, and $\tau_D$ are assumed for FIG. 17 as for previously discussed FIGS. 15 and 16. The time axis is plotted in units of $\tau_{P1}$.

From a quiescent first position, the cantilevered element is first deflected an amount $D_1$ away from nozzle 30 by applying an electrical pulse to the second deflector layer 24 (see FIG. 18*a, b*). This has the effect of reducing the liquid pressure at the nozzle and caused the meniscus to retreat within the nozzle 30 bore toward the liquid chamber 12. Then, after a selected waiting time $\tau_{W1}$, the cantilevered element is deflected an amount $D_2$ toward the nozzle to cause drop ejection. If the waiting time $\tau_{W1}$ is chosen to so that the resonant motion of the cantilever element 20 caused by the initial thermo-mechanical impulse is toward the nozzle, then the second thermo-mechanical impulse will amplify this motion and a strong positive pressure impulse will cause drop formation.

By changing the magnitude of the initial negative pressure excursion caused by the first actuation or by varying the timing of the second actuation with respect to the excited resonant oscillation of the cantilevered element 20, drops of differing volume and velocity may be produced. The formation of satellite drops may also be affected by the prepositioning of the meniscus in the nozzle and by the timing of the positive pressure impulse.

Plots 270, 272, and 274 in FIG. 17 also show a second set of actuations to generate a second liquid drop emission after waiting a second wait time $\tau_{W2}$. This second wait time, $\tau_{W2}$, is selected to account for the time required for the cantilevered element 20 to have restored to its first or nominal position before a next actuation pulse is applied. The second wait time $\tau_{W2}$, together with the pulse times $\tau_{P1}$, $\tau_{P2}$, and inter-pulse wait time $\tau_{W1}$, establish the practical repetition time $\tau_C$ for repeating the process of liquid drop emission. The maximum drop repetition frequency, $f=1/\tau_C$, is an important system performance attribute. It is preferred that the second wait time $\tau_{W2}$ be much longer than the internal heat transfer time constant $\tau_B$. Most preferably, it is most preferred that $\tau_{W2}>3\tau_B$ for efficient and reproducible activation of the thermal actuators and liquid drop emitters of the present invention.

The parameters of electrical pulses applied to the dual thermo-mechanical actuation means of the present inventions, the order of actuations, and the timing of actuations with respect to the thermal actuator physical characteristics, such as the heat transfer time constant $\tau_B$ and the resonant oscillation period $\tau_R$, provide a rich set of tools to design desirable predetermined displacement versus time profiles. The dual actuation capability of the thermal actuators of the present inventions allows modification of the displacement versus time profile to be managed by an electronic control system. This capability may be used to make adjustments in the actuator displacement profiles for the purpose of maintaining nominal performance in the face of varying application data, varying environmental factors, varying working liquids or loads, or the like. This capability also has significant value in creating a plurality of discrete actuation profiles that cause a plurality of predetermined effects, such as the generation of several predetermined drop volumes for creating gray level printing.

While much of the foregoing description was directed to the configuration and operation of a single drop emitter, it should be understood that the present invention is applicable to forming arrays and assemblies of multiple drop emitter units. Also it should be understood that thermal actuator devices according to the present invention may be fabricated concurrently with other electronic components and circuits, or formed on the same substrate before or after the fabrication of electronic components and circuits.

Furthermore, the forgoing description illustrates preferred embodiments of the inventions which result in a cantilevered element including a first deflection layer 22, a barrier layer 23, and a second deflector layer 24. It should be understood that a dual actuated cantilever with substantially the same behavior as that disclosed may be configured and fabricated using any number of additional thermo-elastic layers, passivation layers, adhesion layers or layers to provide other functions. First deflection layer 22, barrier layer 23, and second deflector layer 24 may each be composed of sub-layers of different materials or graded compositions of the same materials. Means for actuating additional layers may also be employed to supplement the dual opposing actuations described in the foregoing.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

PARTS LIST

10 substrate base element
11 heat sink portion of substrate 10
12 liquid chamber
13 gap between cantilevered element and chamber wall
14 wall edge at cantilevered element anchor
15 thermal actuator
16 liquid chamber curved wall portion
20 cantilevered clement
20*a* cantilevered element bending portion
20*b* cantilevered element anchor portion
20*c* cantilevered element free end portion
21 passivation layer
22 first deflector layer
23 barrier layer
23*a* barrier layer sub-layer
23*b* barrier layer sub-layer
24 second deflector layer

25 passivation layer
26 resistor portion of first deflector layer
27 resistor portion of second deflector layer
28 liquid chamber structure, walls and cover
29 sacrificial layer
30 nozzle
33 thin film resistor heater structure
41 TAB lead attached to electrode 44
42 electrode of first electrode pair
43 solder bump on electrode 44
44 electrode of first electrode pair
45 TAB lead attached to electrode 46
46 electrode of second electrode pair
47 solder bump on electrode 46
48 electrode of second electrode pair
50 drop
52 liquid meniscus at nozzle 30
60 fluid
80 mounting structure
100 ink jet printhead
110 drop emitter unit
200 electrical pulse source
300 controller
400 image data source
500 receiver

What is claimed is:

1. A thermal actuator for a micro-electromechanical device comprising:

(a) a base element;

(b) a cantilevered element extending from the base element residing in a first position, the cantilevered element including a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion, wherein the barrier layer is bonded between the first and second deflector layers;

(c) a first pair of electrodes connected to the first deflector layer to apply an electrical pulse to cause resistive heating of the first deflector layer, resulting in a thermal expansion of the first deflector layer relative to the second deflector layer;

(d) a second pair of electrodes connected to the second deflector layer to apply an electrical pulse to cause resistive heating of the second deflector layer, resulting in a thermal expansion of the second deflector layer relative to the first deflector layer, wherein application of an electrical pulse to either the first pair or the second pair of electrodes causes deflection of the cantilevered element away from the first position to a second position, followed by restoration of the cantilevered element to the first position as heat diffuses through the barrier layer and the cantilevered element reaches a uniform temperature.

2. The thermal actuator of claim 1 wherein the first electrically resistive material and the second electrically resistive material are the same material.

3. The thermal actuator of claim 2 wherein the first deflector layer and the second deflector layer are substantially equal in thickness.

4. The thermal actuator of claim 2 wherein the first and second electrically resistive materials are titanium aluminide.

5. The thermal actuator of claim 1 wherein the barrier layer is a laminate structure comprised of more than one low thermal conductivity material.

6. The thermal actuator of claim 1 wherein the electrical pulse has a time duration of $\tau_P$, the barrier layer has a heat transfer time constant of $\tau_B$, and $\tau_B > 2\ \tau_P$.

7. A thermal actuator for a micro-electromechanical device comprising:

(a) a base element;

(b) a cantilevered element extending from the base element residing in a first position, the cantilevered element including a first deflector layer constructed of a first electrically resistive material having a large coefficient of thermal expansion, a second deflector layer constructed of a second electrically resistive material having a large coefficient of thermal expansion, and a barrier layer which is thinner than the first and second deflector layers and constructed of a dielectric material having low thermal conductivity and is bonded between the first and second deflector layers;

(c) a first pair of electrodes connected to the first deflector layer to apply an electrical pulse to cause resistive heating of the first deflector layer, resulting in a thermal expansion of the first deflector layer relative to the second deflector layer;

(d) a second pair of electrodes connected to the second deflector layer to apply an electrical pulse to cause resistive heating of the second deflector layer, resulting in a thermal expansion of the second deflector layer relative to the first deflector layer, wherein application of an electrical pulse to either the first pair or the second pair of electrodes causes deflection of the cantilevered element away from the first position to a second position, followed by restoration of the cantilevered element to the first position as heat diffuses through the barrier layer and the cantilevered element reaches a uniform temperature.

8. The thermal actuator of claim 7 wherein the first and second deflector layers are constructed of materials having substantially equal coefficients of thermal expansion and Young's moduli and are substantially equal in thickness.

9. The thermal actuator of claim 7 wherein the first electrically resistive material and the second electrically resistive material are the same material.

10. The thermal actuator of claim 9 wherein the first deflector layer and the second deflector layer are substantially equal in thickness.

11. The thermal actuator of claim 9 wherein the first and second electrically resistive materials are titanium aluminide.

12. The thermal actuator of claim 7 wherein the barrier layer is a laminate structure comprised of more than one low thermal conductivity material.

13. The thermal actuator of claim 7 wherein the electrical pulse has a time duration of $\tau_P$, the barrier layer has a heat transfer time constant of $\tau_B$, and $\tau_B > 2\tau_P$.

14. A method for operating a thermal actuator, said thermal actuator comprising a base element, a cantilevered element extending from the base element and residing in a first position, the cantilevered element including a barrier layer, having a heat transfer time constant of $\tau_B$, bonded between a first deflector layer constructed of a first electrically resistive material having a large coefficient of thermal expansion and a second deflector layer constructed of a second electrically resistive material having a large coefficient of thermal expansion; a first pair of electrodes connected to the first deflector layer to apply an electrical pulse to heat the first deflector layer; and a second pair of electrodes connected to the second deflector layer to apply an electrical pulse to heat the second deflector layer the method for operating comprising:

(a) applying to the first pair of electrodes a first electrical pulse which provides sufficient heat energy to cause a first deflection of the cantilevered element;

(b) waiting for a time $\tau_{W1}$;

(c) applying to the second pair of electrodes a second electrical pulse which provides sufficient heat energy to cause a second deflection of the cantilevered element; wherein the time $\tau_{W1}$ is selected to achieve a predetermined resultant of the first and second deflections.

15. The method of claim 14 wherein the first electrical pulse has a time duration of $\tau_{P1}$, where $\tau_{P1}<\frac{1}{2}\tau_B$, and the second electrical pulse has a time duration of $\tau_{P2}$, where $\tau_{P2}<\frac{1}{2}\tau_B$.

16. The method of claim 14 wherein the time $\tau_{W1}$ is selected so that the second deflection acts to restore the cantilevered element to the first position.

17. The method of claim 14 wherein the time $\tau_{W1}$ is selected so that the second deflection acts to increase a residual velocity of the cantilevered element resulting from the first deflection.

18. The method of claim 14 further comprising:

(d) waiting for a time $\tau_{W2}$ before applying a next electrical pulse, where $\tau_{W2}>3\tau_B$, so that heat diffuses through the barrier layer and the cantilevered element reaches a uniform temperature.

19. A liquid drop emitter comprising:

(a) a chamber, formed in a substrate, filled with a liquid and having a nozzle for emitting drops of the liquid;

(b) a thermal actuator having a cantilevered element extending from a wall of the chamber and a free end residing in a first position proximate to the nozzle, the cantilevered element including a barrier layer constructed of a dielectric material having low thermal conductivity, a first deflector layer constructed of a first electrically resistive material having a large coefficient of thermal expansion, and a second deflector layer constructed of a second electrically resistive material having a large coefficient of thermal expansion, wherein the barrier layer is bonded between the first and second deflector layers;

(c) a first pair of electrodes connected to the first deflector layer to apply an electrical pulse to cause resistive heating of the first deflector layer, resulting in a thermal expansion of the first deflector layer relative to the second deflector layer;

(d) a second pair of electrodes connected to the second deflector layer to apply an electrical pulse to cause resistive heating of the second deflector layer, resulting in a thermal expansion of the second deflector layer relative to the first deflector layer, wherein application of electrical pulses to the first and second pairs of electrodes causes rapid deflection of the cantilevered element, ejecting liquid at the nozzle, followed by restoration of the cantilevered element to the first position as heat diffuses through the barrier layer and the cantilevered element reaches a uniform temperature.

20. The liquid drop emitter of claim 19 wherein the first and second electrically resistive materials have substantially equal coefficients of thermal expansion and Young's modulus and are substantially equal in thickness.

21. The liquid drop emitter of claim 19 wherein the first electrically resistive material and the second electrically resistive material are the same material.

22. The liquid drop emitter of claim 21 wherein the first deflector layer and the second deflector layer are substantially equal in thickness.

23. The liquid drop emitter of claim 19 wherein the first and second electrically resistive materials are titanium aluminide.

24. The liquid drop emitter of claim 19 wherein the barrier layer is thinner than the first and second deflector layers.

25. The liquid drop emitter of claim 19 wherein the barrier layer is a laminate structure comprised of more than one low thermal conductivity material.

26. The liquid drop emitter of claim 19 wherein the barrier layer has a heat transfer time constant of $\tau_B$ and the electrical pulses have time durations of less than $\frac{1}{2}\tau_B$.

27. The liquid drop emitter of claim 19 wherein the liquid drop emitter is a drop-on-demand ink jet printhead and the liquid is an ink for printing image data.

28. A method for operating a liquid drop emitter, said liquid drop emitter comprising a chamber, filled with a liquid, having a nozzle for emitting drops of the liquid; a thermal actuator having a cantilevered element extending from a wall of the chamber and a free end residing in a first position proximate to the nozzle for exerting pressure on the liquid at the nozzle, the cantilevered element including a barrier layer, having a heat transfer time constant of $\tau_B$, bonded between a first deflector layer constructed of a first electrically resistive material having a large coefficient of thermal expansion and a second deflector layer constructed of a second electrically resistive material having a large coefficient of thermal expansion; a first pair of electrodes connected to the first deflector layer to apply an electrical pulse to heat the first deflector layer; and a second pair of electrodes connected to the second deflector layer to apply an electrical pulse to heat the second deflector layer; the method for operating comprising:

(a) applying to the first pair of electrodes a first electrical pulse which provides sufficient heat energy to cause a first deflection of the cantilevered element;

(b) waiting for a time $\tau_{W1}$;

(c) applying to the second pair of electrodes a second electrical pulse which provides sufficient heat energy to cause a second deflection of the cantilevered element; wherein the time $\tau_{W1}$ is selected to achieve a predetermined motion of the thermal actuator resulting in liquid drop emission.

29. The method of claim 28 wherein the first electrical pulse has a time duration of $\tau_{P1}$, where $\tau_{P1}<\frac{1}{2}\tau_B$, and the second electrical pulse has a time duration of $\tau_{P2}$, where $\tau_{P2}<\frac{1}{2}\tau_B$.

30. The method of claim 28 wherein the time $\tau_{W1}$ is selected so that the second deflection acts to restore the thermal actuator to the first position.

31. The method of claim 28 wherein the time $\tau_{W1}$ is selected so that the second deflection acts to increase a residual velocity of the thermal actuator resulting from the first deflection.

32. The method of claim 28 wherein parameters of the first electrical pulse and second electrical pulses, and the time $\tau_{W1}$, are adjusted to change a characteristic of the liquid drop emission.

33. The method of claim 32 wherein the characteristic of the liquid drop emission is the drop volume.

34. The method of claim 32 wherein the characteristic of the liquid drop emission is the drop velocity.

35. The method of claim 28 further comprising:

(d) waiting for a time $\tau_{W2}$ before applying a next electrical pulse, where $\tau_{W2}>3\tau_B$, so that heat diffuses through the barrier layer, the cantilevered element reaches a uniform temperature and the free end is restored substantially to the first position before next emitting liquid drops.

* * * * *